US006398906B1

(12) United States Patent
Kobayashi et al.

(10) Patent No.: US 6,398,906 B1
(45) Date of Patent: Jun. 4, 2002

(54) WAFER TRANSFER APPARATUS AND WAFER POLISHING APPARATUS, AND METHOD FOR MANUFACTURING WAFER

(75) Inventors: Tatsunori Kobayashi; Hiroshi Tanaka; Jiro Kajiwara, all of Omiya (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/523,757

(22) Filed: Mar. 13, 2000

(30) Foreign Application Priority Data

Mar. 15, 1999 (JP) ..... 11-069336
Mar. 15, 1999 (JP) ..... 11-069337
Mar. 15, 1999 (JP) ..... 11-069338
May 14, 1999 (JP) ..... 11-135019

(51) Int. Cl.[7] ..... B24B 7/00
(52) U.S. Cl. ..... 156/345.12
(58) Field of Search ..... 156/345

(56) References Cited

U.S. PATENT DOCUMENTS 5,664,990 A * 9/1997 Adams et al. ..... 451/60
5,860,853 A * 1/1999 Hasegawa et al. ..... 451/285
5,885,140 A * 3/1999 Hakomori ..... 451/72
5,913,719 A * 6/1999 Hasegawa et al. ..... 451/364
6,019,670 A * 2/2000 Cheng et al. ..... 451/56
6,190,494 B1 * 2/2000 Cheng et al. ..... 451/56
6,116,992 A * 9/2000 Prince ..... 451/286
6,143,127 A * 11/2000 Perlov et al. ..... 156/345
6,165,056 A * 12/2000 Hayashi et al. ..... 451/281
6,221,773 B1 * 4/2001 Yasui et al. ..... 438/690
6,224,472 B1 * 5/2001 Lai et al. ..... 451/398

OTHER PUBLICATIONS

Related case S.N. 09/523,757 Filed Mar. 13, 2000.*
Related case S.N. 09/651,299 Filed Aug. 30, 2000.*

* cited by examiner

*Primary Examiner*—Gregory Mills
*Assistant Examiner*—Sylviar MacArthur
(74) *Attorney, Agent, or Firm*—Oblon, Spivak, McClelland, Maier & Neustadt, P.C.

(57) ABSTRACT

The present invention provides a wafer polishing apparatus provided with a platen on the surface of which a polishing pad is affixed, and a wafer holding head for allowing one face of a wafer to contact the polishing pad by holding the wafer to be polished, the wafer being polished by a relative motion between the wafer holding head and the platen, wherein a dress ring is provided with an abrasive grain layer at the lower part at the outside of the wafer holding head so as to be rotatable while being in contact with the surface of the polishing pad.

14 Claims, 20 Drawing Sheets

FIG.18 *(PRIOR ART)*

WAFER TRANSFER APPARATUS AND WAFER POLISHING APPARATUS, AND METHOD FOR MANUFACTURING WAFER

BACKGROUND OF THE INVENTION

1. Field of the Invention

The present invention relates to a wafer transfer apparatus for delivering a wafer to be polished to a wafer holding head and for receiving a polished wafer from the wafer holding head. The present invention also relates to a wafer polishing apparatus to be used for an apparatus for polishing the surface of a semiconductor wafer, and a method for manufacturing the wafer.

The specification of the present invention is based on the Japanese Patent Applications (Japanese Patent Application Nos. 11-69336, 11-69337, 11-69338 and 11-35019), and the content of these Japanese applications are incorporated herein by references.

2. Description of the Related Art

Fine patterning of semiconductor wafers has been developed in recent years as a result of development of highly integrated semiconductor devices. Since fine patterning of the wafers having multilayer structures have been made easy and secure, it is particularly important to planarize the surface of semiconductor wafers as fine as possible in the manufacturing process. Finer planarization of the surface of the semiconductor wafers allows patterning precision to be improved besides making focusing of the exposed light easy when a photolithographic process is used for patterning. In addition, production of the semiconductor wafers can enjoy a low cost because the work efficiency is improved without providing complicated equipments for manufacturing the semiconductor wafers.

A chemical-mechanical polishing method (a CMP method) has been highlighted for this purpose since the method can polish the surface film with a high degree of planarity.

The surface of wafers are mechanically and chemically polished and planarized using an alkaline slurry containing $SiO_2$, a neutral slurry containing $SeO_2$, an acidic slurry containing $Al_2O_3$, or a slurry containing other abrasive (these are simply referred as a slurry hereinafter) in the CMP method. A wafer holding head for holding the wafer (a wafer holding head) and a polishing pad are usually disposed in opposed relation with each other in the wafer polishing apparatus for polishing the surface of the wafer, and the wafer is polished by allowing the wafer polishing head to rotate on the polishing pad by pressing the surface of the wafer onto the polishing pad while feeding a slurry.

Although it is desirable that the polishing pad is as planar as possible, its surface is deteriorated to cause decrease of polishing ability (polishing rate) by using it for polishing the wafer, or polishing performance (uniformity of polishing or degree of distribution of the thickness of the remaining film on the wafer) is decreased by causing a little roughness or inclination on the surface of the polishing pad, due to uneven abrasion or clogging of the pad after polishing. Therefore, the polishing pad is subjected to reforming (dressing) for restoring the polishing performance of the polishing pad, by allowing the polishing pad after finishing a wafer polishing process to rotates while allowing its surface to contact a dresser.

The polishing process may be simultaneously carried out with the dressing process as shown in FIGS. 18 and 19. In the first conventional example shown in FIG. 18, the wafer polishing apparatus 250 is provided with a wafer holding head 252 attached at the tip of an arm 251 supported to be able to freely pivot, a slurry feed means 253 for feeding a slurry to a polishing pad 256, and a dresser 254. The slurry feed device 253 directly feeds the slurry to the polishing pad 256 affixed on the surface of a platen 255, and the wafer W held on the wafer holding head 252 is polished by allowing the wafer W to rotate while making contact with the surface of the polishing pad 256. The dresser 254 is, on the other hand, held in rotatable manner with a driving mechanism 257, which is supported on a base 258. The base 258 is also supported to be linearly slidable along the direction indicated by an arrow Y with a guide member 259. The dresser 254 dresses the surface of the polishing pad 256 that has a deteriorated polishing performance after polishing the wafer W. The wafer is polished at a different site from the site for dressing the wafer on the polishing pad 256.

In the second conventional example shown in FIG. 19, the wafer polishing apparatus 300 is provided with three rotatable platens 301 and polishing pads 302 affixed on their surfaces, wafer holding heads 304 provided at the tips of respective two branched arms 303, and dressers 306 that is able to linearly slide along a guide member 305 provided along the radial direction of each polishing pad 302. The arm 303 is supported with a pivot 303*a* to be able to freely pivot, and the wafers supported with the wafer holding heads 304 are polished with respective polishing pads 302. The surface of the polishing pad 302 is dressed with the dresser 306 that is slidable along the radial direction of the polishing pad 302, while simultaneously polishing the wafer.

The third conventional example of the wafer polishing apparatus comprises an apparatus using a wafer holding head 350 as shown in FIG. 20.

In FIG. 20, the wafer holding head 350 is provided with a head body 353 comprising a top plate 351 and a cylindrical circumference wall 352 fixed to the circumference of the top plate 351, a diaphragm 354 expanded in the head body 353 and comprising an elastic material such as a rubber, a pressure adjustment mechanism 356 for adjusting the pressure in a fluid chamber 358, a disk-shaped carrier 355 fixed on the lower face of the diaphragm 354, and a ring-shaped retainer ring 357 disposed in concentric relation to the outer circumference of the carrier 355.

The carrier 355 and the retainer ring 357 are fixed on a carrier fixing ring 359 and a retainer ring fixing ring 362, respectively, provided on the upper face of the diaphragm 354. The retainer ring 357 is disposed in concentric relation with a slight gap between the outer circumference face of the carrier 355 and the circumference wall 352. The slight gap is provided for suppressing the displacement range of the retainer ring 357 along the radial direction from being too large due to elastic deformation of the diaphragm 354.

The wafer W is affixed on a wafer affix sheet S (an insert) provided on the lower face of the carrier 355, while the outer circumference of the wafer W being locked with the retainer ring 357. The wafer is polished by allowing the wafer holding head 350 and the platen 361 to rotate causing a relative movement, when the slurry is fed onto the surface of the polishing pad 363 and the polishing face of the wafer W from outside of the wafer holding head 350, while allowing the surface of the wafer W to contact the polishing pad 363 affixed on the upper face of the platen 361.

The carrier 355 and the retainer ring 357 has a floating structure in which both members are able to independently displace along the ascending and descending directions by deformation of the diapliragm 354. The pressing pressure of the carrier 355 and the retainer ring 357 onto the polishing pad 363 changes depending on the pressure in the fluid chamber 358 adjusted with pressure adjustment mechanism 356.

While the wafer polishing apparatus as shown in the first and second conventional examples is effective for polishing the wafer, since the wafer polishing process and the dressing process can be simultaneously applied. However, when the wafer is polished with the wafer polishing apparatus as shown in the first conventional example, the slurry is directly fed onto the surface of the polishing pad 256 from outside of the wafer holding head 252. Most of the fed slurry flows out by the centrifugal force applied to the rotating platen 255, forcing to feed a large amount of the slurry for obtaining a sufficient polishing effect. A large amount of an expensive abrasive is wasted without effectively using the slurry. In addition, the polishing debris generated by polishing has been washed out by feeding the slurry on the surface of the polishing pad, also wasting a large amount of the slurry to make the removing method to be high cost with poor efficiency. This problem is common in the wafer polishing apparatus shown in the third conventional example.

Since the dresser 254 occupies a large installation area, a few numbers of wafers holding head 252 are attachable to decrease service efficiency of the apparatus.

In the second conventional example, the dresser 306 has a smaller size than the dresser 302, and is linearly travels relative to the polishing pad 302. Accordingly, it is difficult to uniformly press the entire polishing pad 302, thereby planarization of the surface of the polishing pad 302 has been insufficient.

The fourth conventional example of the wafer polishing apparatus is shown in FIG. 21. The wafer polishing apparatus 400 is provided with a wafer holding head 401 for holding the wafer W to be polished, and a polishing pad 402 affixed on the entire upper face of the platen 403 formed into a disk shape. A plurality of the wafer holding heads 401 are mounted at the bottom of a carousel 404 as a head driving mechanism, which is supported with a spindle 411 and undergoes a planetary motion on the polishing pad 402. It is possible to dispose the center of the platen 403 and the center of rotation of the wafer holding head 401 in eccentric relation with each other.

The platen 403 is horizontally disposed at the center of a base 405, and rotates around the axis line with a platen driving mechanism provided in the base 405. Guide posts 407 are provided at the side of the base 405, and an upper mounting plate (bridge) 409 for supporting a carousel driving mechanism 410 is disposed among the guide posts 407. The carousel driving mechanism 410 serves for allowing a carousel 404 provided below the device to rotate around the axis line.

Bridge supports 412 are disposed so as to protrude upward from the base 405, and a gap adjustment mechanism 413 is provided on the tip of each bridge support 412. A locking member 414 is disposed, on the other hand, above the bridge support 412 in an opposed relation with each other. The locking member 414 is fixed to the upper mounting plate (bridge) 409, and protrude downward from the upper mounting plate (bridge) 409. The space between the wafer holding head 401 and the polishing pad 402 is adjusted by adjusting the gap adjustment mechanism 413 to allow the bridge support 412 to contact the locking member 414. The wafer W is polished by allowing the wafer held on the wafer holding head 401 to contact the surface of the polishing pad 402, while allowing the carousel 404 and the platen 403 to rotate.

While a plurality of the wafer holding heads 401 holding the wafers W are provided, the position of the wafer holding head 401 sometimes finely shifts from the position of the polishing pad 402 affixed on the platen 403, when the thickness of the polishing pad 402 has been reduced by polishing, thereby causing a problem that uniformity and polished planarity of the wafer W become to be poor. However, adjusting the gap adjustment mechanism 413 every time is not only not practical, but also making it difficult to adjust the positioning of the wafer holding head and polishing pad to right and left in a $\mu$m unit using the gap adjustment mechanism 413, while suffering the pressing pressure generated during polishing. Also, the positional shift is caused by dimensional changes of the wafer holding head 401, thereby manufacturing excessively polished wafers and insufficiently polished wafers.

Polishing of the wafer W using the polishing apparatus shown in the second conventional example will be described hereinafter. In FIG. 19, the wafer W to be polished is held on each wafer holding head 304 provided at each tip of the two branched arms 303. These wafers W are polished by rotation while they are allowed to contact each pad 302 (referred as respective polishing pads 302*a*, 302*b*, and 302*c* hereinafter) affixed on respective surfaces of three rotatable platens 301. The polishing pads 302*a* and 302*b* serve as primary polishing pads, while the polishing pad 302*c* serves as a secondary polishing pad. These polishing pads 302*a*, 302*b* and 302*c* are dressed with the dressers 306 being able to linearly shift with the guide members 305 provided along respective radial directions. The an 303 is supported with the pivot 303*a* to be able to freely pivot. The wafer W is subjected to secondary polishing with the polishing pad 302*c*, after being subjected to primary polishing with the polishing pads 302*a* and 302*b*. The Wafer W is attached to and detached from the wafer holding head 304 with a flexible handling robot 307 at a wafer attaching and detaching station 308. The handling robot 307 takes out a wafer W to be polished from a second cassette 309, and attaches the wafer W to the wafer holding head 304 at the wafer attaching and detaching station 308. The wafer W after completing polishing is detached from the wafer holding head 304 with the handling robot 307 at the wafer attaching and detaching station 308, and transferred to a receiving cassette 310.

Since the wafer is attached to and detached from the wafer holding head 304 with the flexible handling robot 307, the construction of the handling robot 307 becomes complicated. Consequently, reliability of handling operation to the wafer W is compromised, or maintenance such as cleaning of the apparatus becomes difficult. Since flexible access range of the handling robot 307 should be enlarged for attaching and detaching a plurality of wafers W to the wafer holding head 304, the handling robot 307 brings about to be large size and complicated, thereby slowing its operation to decrease operation efficiency.

While making the handling robot 307 itself as a wafer attaching-detaching member movable may be contemplated, it causes decrease of reliability and work efficiency because the overall apparatus is complicated, and positioning relative to the wafer holding head 304 becomes difficult.

SUMMARY OF THE INVENTION

Accordingly, the object of the present invention is to provide a wafer polishing apparatus that is able to simultaneously and efficiently polish the wafer and dress the polishing pad, and a method for manufacturing the wafer.

For attaining the object above, the present invention provides a wafer polishing apparatus provided with a platen on the surface of which a polishing pad is affixed, and a wafer holding head for allowing one face of a wafer to contact the polishing pad by holding the wafer to be polished, the wafer being polished with the polishing pad by a relative motion between the wafer holding head and the platen, wherein a cylindrical dress ring comprising an abrasive grain layer on its lower part is provided at the outside of the wafer holding head in a rotatable manner while the dress ring is allowed to contact the surface of the polishing pad.

According to the wafer polishing apparatus of the present invention, polishing of the wafer and dressing of the polishing pad are simultaneously carried out, thereby allowing the step number to be decreased and polishing work to be efficient. Dressing of the polishing pad is efficiently carried out while enabling the entire polishing pad to be planarized, by rotating the cylindrical dress ring.

The present invention also provides a method for manufacturing a wafer provided with a platen on the surface of which a polishing pad is affixed, and a wafer holding head for allowing one face of a wafer to contact the polishing pad by holding the wafer to be polished, comprising a polishing step for polishing the wafer with the polishing pad by a relative motion between the wafer holding head and the platen, wherein a cylindrical dress ring comprising an abrasive grain layer on its lower part is provided at the outside of the wafer holding head, and wherein polishing of the wafer and dressing of the polishing pad are simultaneously carried out by rotating the dress ring while allowing it to contact the surface of the polishing pad.

According to the method for manufacturing the wafer in the present invention, the wafer is efficiently polished because polishing of the wafer and dressing of the polishing pad can be simultaneously carried out.

An another object of the present invention is to provide a wafer polishing apparatus and a method for manufacturing the wafer, by which the wafer is efficiently polished by saving consumption of the slurry.

For attaining the above object, the present invention provides a wafer polishing apparatus provided with a platen on the surface of which a polishing pad is affixed, and a wafer holding head for allowing one face of a wafer to contact the polishing pad by holding the wafer to be polished, the wafer being polished with the polishing pad by a relative motion between the wafer holding head and the platen, comprising a slurry pocket, in which a slurry is accommodated and which has an opening at the polishing pad side, formed at a part of a contact portion between the periphery of the portion holding the wafer on the lower face of the wafer holding pad and the polishing pad, and a slurry feed member for feeding the slurry to the slurry pocket are provided.

According to the polishing apparatus of the present invention, the slurry is held with the slurry pocket and the polishing pad, since the slurry pocket accommodating the slurry is formed at a part of the contact portion between the periphery of the wafer holding portion on the lower face of the wafer holding head, and the polishing pad. Consequently, the amount of the slurry flowing out by centrifugal force is diminished even when the polishing pad affixed on the platen rotates. The slurry in the slurry pocket is uniformly fed on the surface of the polishing pad, by allowing the wafer holding pad and the platen to rotate, thus enabling the wafer to be efficiently polished.

The present invention also provides a wafer polishing apparatus provided with a platen on the surface of which a polishing pad is affixed, and a wafer holding head, which holds a wafer to be polished, for allowing the polishing pad to contact one face of the wafer, the wafer being polished with the polishing pad by a relative motion between the wafer holding head and the platen, wherein a slurry holding ring, which is allowed its lower face to contact the polishing pad, and which is disposed so as not to contact the periphery of the wafer holding head, is provided to be rotatable at the outside of the wafer holding head.

According to the wafer polishing apparatus of the present invention, the amount of the flowing out abrasive is reduced by providing the slurry holding ring.

The present invention also provides a method for manufacturing a wafer provided with a platen on the surface of which a polishing pad is affixed, and a wafer holding head for holding a wafer to be polished by allowing one face of the wafer to contact the polishing pad, comprising a polishing step for polishing the wafer with the polishing pad by a relative motion between the wafer holding head and the platen, wherein a slurry pocket, which is open to the polishing pad side, for feeding a slurry is provided at the periphery of the wafer holding portion on the lower face of the wafer holding head, the wafer holding head being allowed to rotate while allowing the lower face of the wafer holding head to contact the polishing pad, and the wafer being polished by feeding a slurry on the polishing face of the wafer and on the surface of the polishing pad while suppressing the slurry fed to the slurry pocket from flowing out.

According to the method for manufacturing the wafer in the present invention, the wafer is efficiently polished using a minimum amount of the slurry, because the slurry is fed into the wafer holding head. Also, flowing out of abrasive due to rotation of the platen is suppressed to reduce the amount of use of the slurry, because the wafer is polished while allowing the wafer holding head to contact the polishing pad so that the opening of the slurry pocket is blocked with the polishing pad.

The present invention also provides a method for manufacturing a wafer provided with a platen on the surface of which a polishing pad is affixed, and a wafer holding head for allowing one face of a wafer to contact the polishing pad by holding the wafer to be polished, comprising a polishing step for polishing the wafer with the polishing pad by a relative motion between the wafer holding head and the platen, wherein a slurry holding ring, which is provided so as to contact the polishing pad and not to contact the outer circumference of the wafer holding head, is disposed at the outside of the wafer holding head, wherein the slurry is fed between the outer circumference of the wafer holding head and the slurry holding ring while allowing the wafer holding head and the slurry holding ring to rotate, and wherein the wafer is polished while suppressing the slurry from flowing out by the slurry holding ring.

According to the method for manufacturing the wafer in the present invention, an efficient polishing is made possible by directly feeding the slurry from the periphery of the wafer, by allowing the slurry to be fed between the slurry holding ring and the wafer holding head, besides being able to suppress consumption of the slurry by reducing the amount of thee flowing out abrasive with the slurry holding ring.

A different object of the present invention is to provide a wafer polishing apparatus and a method for manufacturing the wafer that is able to simultaneously and securely polish a plurality of wafers.

The present invention for attaining the above object provides a wafer polishing apparatus provided with a platen on the surface of which a polishing pad is affixed, and a wafer holding head for allowing one face of a wafer to contact the polishing pad by holding the wafer to be polished, the wafer being polished by a relative motion between the wafer holding head and the platen, comprising: a spindle, which is coupled to the upper part of the wafer holding head, for supporting the wafer holding head in horizontally and freely rotatable manner; and a spindle supporting member provided with a plurality of spindle housings having a cylindrical engage member for engaging the spindle, the spindle comprising a positioning mechanism for positioning the wafer holding head along the axis line direction by changing the relative position against the spindle supporting member.

According to the wafer polishing apparatus in the present invention, plural wafers are securely polished while maintaining a constant polishing condition for each wafer, because each of the plural wafer holding heads can be individually positioned with the positioning mechanism along the axis direction.

The present invention also provides a method for manufacturing a wafer provided with a platen on the surface of which a polishing pad is affixed, and a wafer holding head for allowing one face of a wafer to contact the polishing pad by holding the wafer to be polished, comprising a polishing step for polishing the wafer by a relative motion between the wafer holding head and the platen, wherein a spindle for supporting the wafer holding head in a horizontally and freely rotatable manner engages respective engage members of a plurality of spindle housings provided on the spindle supporting member, wherein the wafer is allowed to rotate while making contact with the polishing pad, and wherein the plural wafers are polished while being individually positioned by positioning the wafer holding head along the axis line so as to change the relative position against the spindle supporting member using a positioning mechanism provided on the spindle.

According to the method for manufacturing the wafer in the present invention, individual wafers are securely polished by fine-tuning the polishing states and polishing conditions, because the wafer holding head can be positioned during polishing the wafer.

A further different object of the present invention is to provide a wafer transfer apparatus and a wafer polishing apparatus, and a method for manufacturing the wafer, by which the wafer can be accurately and securely attached to and detached from the wafer holding head, besides efficiently polishing the wafer.

For attaining the above object, the present invention provides a wafer transfer apparatus for delivering wafers to be polished to wafer holding heads for polishing while allowing the wafer to rotate on a polishing pad, and for receiving the wafer, which is polished by being held on the wafer holding head, from the wafer holding head, provided with: a tray being able to mount the wafer; a tray travelling mechanism for allowing the tray to travel below the wafer holding head; and a wafer attaching-detaching mechanism for attaching the wafer to be polished, which is mounted on the tray, on the lower face of the wafer holding head from below the tray, and for receiving the wafer, which is attached to the wafer holding head and is polished, from the wafer holding head to mount on the tray.

According to the wafer transfer apparatus in the present invention, the wafer is transferred by the tray. The tray travels to below the wafer holding head, where the wafer is attached to and detached from the wafer holding head by the wafer attaching-detaching mechanism provided under the wafer holding head. Since the transfer apparatus and the attaching-detaching mechanism are separated with each other, the mechanisms of respective mechanisms turns out to be more simple. Accordingly, each mechanism can be actually operated at high speed, besides improving reliability and making its maintenance easy.

The present invention also provides a wafer polishing apparatus provided with a platen on the surface of which a polishing pad is affixed, and a wafer holding head for allowing one face of a wafer to contact the polishing pad by holding the wafer to be polished, the wafer being polished by a relative motion between the wafer holding head and the platen, comprising: a tray being able to mount the wafer, a tray travelling mechanism for allowing the tray to travel so as to pass below the wafer holding head, and a wafer attaching-detaching mechanism provided at a position in a space apart from the polishing pad for attaching a wafer to be polished, which is mounted on the tray, on the lower face of the wafer holding head, and for receiving the wafer, which is attached on the wafer holding head and is polished, from the wafer holding head to mount on the tray, the wafer holding head being supported so that the upper part of the polishing pad and the upper part of the wafer attaching-detaching means are movable.

According to the wafer polishing apparatus of the present invention, the wafer is transferred with the tray. The tray moves below the wafer holding head, and the wafer is attached to and detached from the wafer holding head by the wafer attaching-detaching mechanism provided there. Since the transfer mechanism and the attaching-detaching mechanism are independent with each other, each mechanism turns out to be simple, thereby speed-up of the function of each mechanism is realized besides improving reliability with easy maintenance.

The wafer holding head moves above the wafer attaching-detaching mechanism when the wafer is attached to and detached from the wafer holding apparatus, and moves above the polishing pad when the wafer is polished. Since the transfer mechanism and the attaching-detaching mechanism are independent with each other, each mechanism turns out to be simple, and operations of respective mechanisms is stabilized without interfering with each other.

The present invention also provides a method for manufacturing a wafer polishing apparatus provided with a platen on the surface of which a polishing pad is affixed, and a wafer holding head for allowing one face of a wafer to contact the polishing pad by holding the wafer to be polished, comprising a polishing step for polishing the wafer by a relative motion between the wafer holding head and the platen; and a wafer transfer step for delivering the wafer to be polished to the wafer holding head, and for receiving the wafer, which is attached to the wafer holding head and is polished, from the wafer holding head, wherein the tray mounting the wafer to be polished is allowed to travel above the wafer attaching-detaching means while allowing the wafer holding head to travel above the tray, wherein the wafer is polished by allowing the wafer holding head to travel on the polishing pad after attaching die wafer mounted on the tray by the wafer attaching-detaching mechanism on the wafer holding head, and wherein the wafer after polishing is delivered to the wafer attaching-detaching mechanism from the wafer holding head to mount the wafer on the tray.

Since the transfer mechanism and the attaching-detaching mechanism are independent with each other according to the method for manufacturing the wafer, each mechanism turns out to be simple, thereby speed-up of the function of each mechanism is realized besides improving reliability with easy maintenance.

The wafer polishing apparatus and the wafer-attaching-detaching mechanism is disposed with a distance apart, besides the wafer holding head moves above the wafer attaching-detaching mechanism when the wafer is attached to and detached from the wafer holding head, and the wafer holding head moves above the polishing pad when the wafer is polished. Consequently, each mechanism turns out to be simple, and operations of respective mechanisms is stabilized without interfering with each other.

DESCRIPTION OF THE PREFERRED EMBODIMENT

Figure 1:
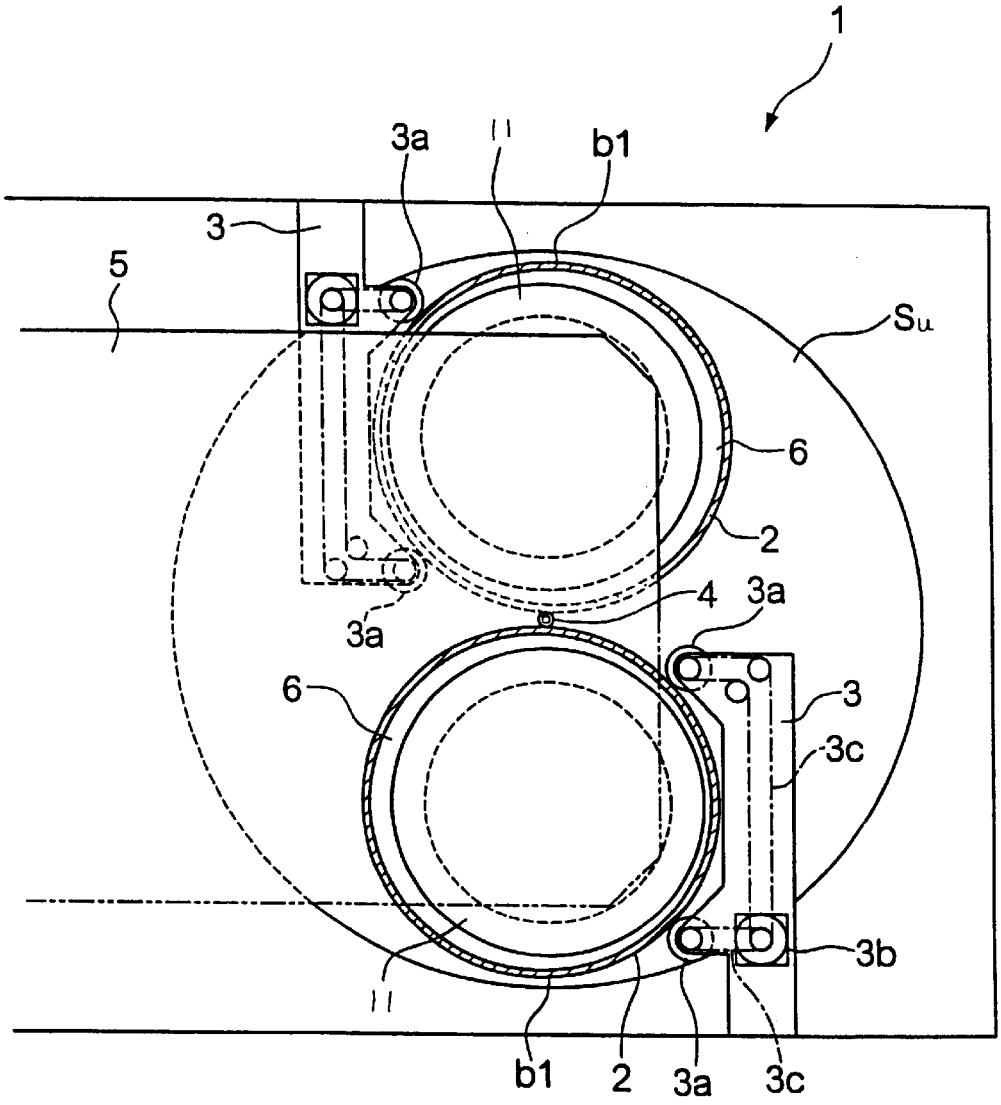
FIG. 1 shows a plane view of the wafer polishing apparatus in the first embodiment of the wafer polishing apparatus according to the present invention.
Figure 2:
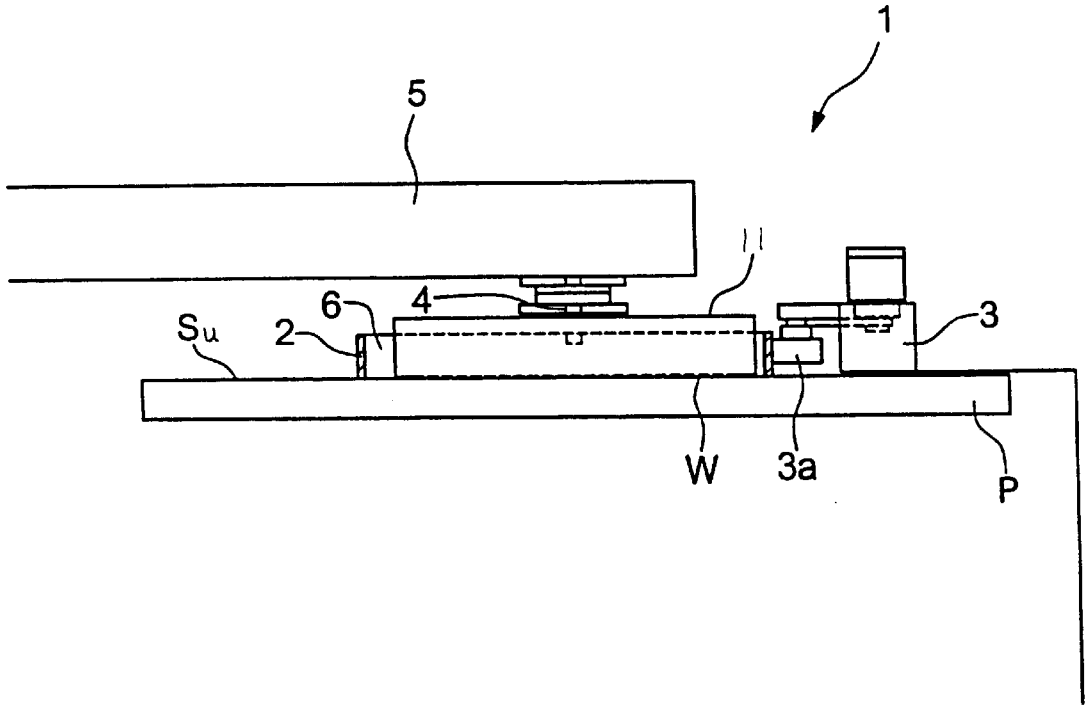
FIG. 2 shows a side cross section of the wafer polishing apparatus shown in FIG. 1.
Figure 3:
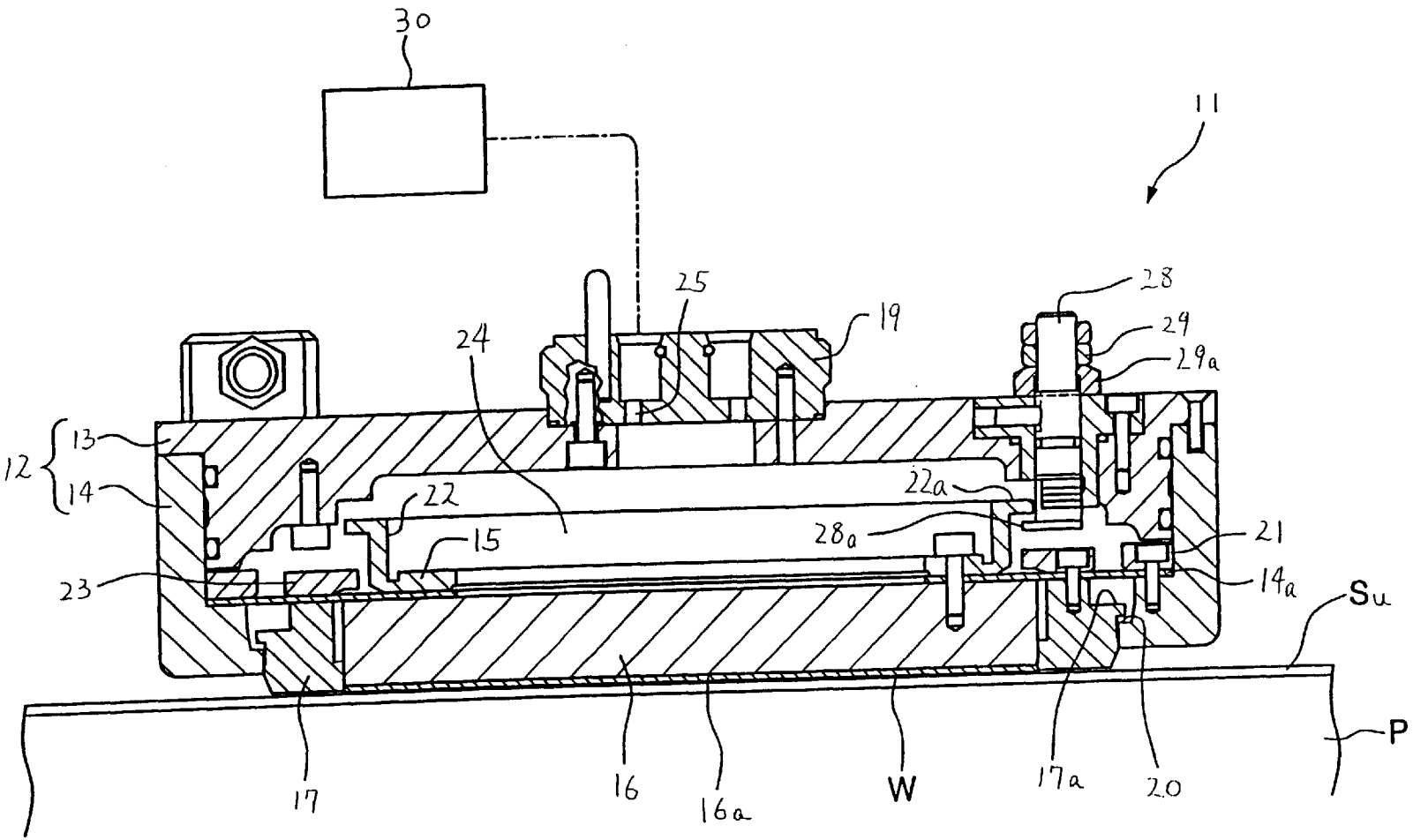
FIG. 3 is a cross section for describing the wafer holding head to be used in the first embodiment.

The wafer polishing apparatus according to the present invention will be described hereinafter with reference to the drawings. FIG. 1 shows a plane view viewed from upward of the wafer polishing apparatus in the first embodiment. FIG. 2 shows a cross section of the wafer polishing apparatus in FIG. 1, and FIG. 3 shows a cross section of one example of the wafer holding head to be used in this embodiment.

In FIGS. 1 and 2, the wafer polishing apparatus 1 is provided with a wafer holding head 11, a dress ring 2 provided at outside of the wafer holding head 11, a ring guide 3 supporting the dress ring 2, and a nozzle 4 as a slurry feed device.

Two wafer holding heads 11 are supported in a freely rotatable manner in this embodiment. A wafer W supported with the wafer holding head 11 contact the surface of a polishing pad Su affixed on a rotatable platen P.

Any materials that have been conventionally used for polishing the wafer may be used for the polishing pad Su, examples of them including a velour type pad prepared by impregnating a nonwoven fabric comprising polyester with a soft resin such as polyurethane, a suede type pad prepared by forming a resin foam layer comprising polyurethane foam on a substrate such as a polyester nonwoven fabric, or a resin foam sheet comprising independently foamed polyurethane.

A ring-shaped dress ring 2 having an abrasive grain layer on its lower end face is provided at the outside of the wafer holding head 11. The dress ring 2 is formed to have a diameter larger than the outer diameter of the wafer holding head 11 and smaller than the radius of the polishing pad Su, and is provided to have a gap 6 from the wafer holding head 11. The abrasive grain layer formed on the lower end face of the dress ring 2 contacts the surface of the polishing pad Su.

The dress ring 2 is mounted on the polishing pad Su, and is allowed to rotate by the frictional force between the dress ring 2 and the polishing pad Su caused by rotation of the platen P. Two roller bearings 3*a* are provided in respective ring guides 3 supporting the dress rings 2 for maintaining the positions of the dress rings 2 so as not to interfere rotation of the dress rings 2.

A nozzle (a slurry feed device) 4 for directly feeding a slurry toward the vicinity of the center of the polishing pad Su is provided on a base 5. The nozzle 4 is provided with its tip to be a distance apart from the surface of the polishing pad Su, for feeding the slurry at the intermediate part of each dress rings 2.

The wafer holding head 11 will be then described.

In FIG. 3, the wafer holding head 11 is provided with a head body 12 comprising a top plate 13 and a cylindrical circumference wall 14, a diaphragm 15 expanded in the head body 12, a disk-shaped carrier 16 fixed on the lower face of the diaphragm 15, and a disk-shaped retainer ring 17 provided in a concentric relation to the inner wall of the circumference wall 14 and the outer circumference face of the carrier 16.

The head body 12 is composed of the disk-shaped top plate 13 and the cylindrical circumference wall 14 fixed at below the outer circumference of the top plate 13, and the lower end of the head body 12 has an hollow opening. The top plate 13 is coaxially fixed to a shaft 19, in which a flow path 25 communicating with a pressure adjusting mechanism 30 is formed along the vertical direction. A step 14*a* and a locking member 20, protruding toward the inside along the radial direction, are formed on the lower end of the circumference wall 14 over the entire circumference.

The diaphragm 15 comprising an elastic material such as a fiber reinforced rubber is formed into a ring-shape or a disk-shape, and is fixed with a diaphragm fixing ring 21 on the step 14*a* formed on the inner wall of the circumference wall 14.

A fluid chamber 24 is formed at above the diaphragm 15, and communicates with the flow path 25 formed in the shaft 19. The pressure in the fluid chamber 24 is adjusted by feeding a fluid such as air from the pressure adjusting mechanism 30 through the flow path 25.

The carrier 16 comprising a highly rigid material such as a ceramic is formed into a disk with an approximately constant thickness, and is fixed with a carrier fixing ring 22 provided on the upper face of the diaphragm 15. A ring-shaped step 22*a* is formed on the upper part of the carrier fixing ring 22, and the step is engaged with a step 28*a* formed at the lower end of stopper bolts 28, which vertically penetrate through the top plate 13, and are fixed with nuts 29 and spacers 29*a*. Consequently, the diaphragm 15 does not suffer an excess force by allowing the step 22*a* to engage with the step 28*a*, even when the diaphragm 15 is bent downward by the weight of the carrier 16 by allowing the wafer holding head, for example, to ascend.

The retainer ring 17 is formed into a ring shape between the inner wall of the circumference wall 14 and the outer circumference face of the carrier 16, and is disposed in a concentric relation to the circumference wall 14 and the carrier 16 with a slight gap between the inner wall of the circumference wall 14 and the outer circumference face of the carrier 16. The retainer ring 17 is fixed with a retainer ring fixing ring 23 provided on the upper face of the diaphragm 15. The upper end face and the lower end face of the retainer ring 17 is formed to be horizontal. A step 17*a* is formed on the outer circumference face of the retainer ring 17, which prevents the retainer ring 17 from being excessively displaced by allowing the step 17*a* to engage with the locking member 20 when the wafer holding head 11 ascends, thereby the diaphragm 15 does not suffer a local force.

A variety of the wafer holding head 11, such as those in which the wafer holding head is supported with the carousel as a head driving mechanism so as to be able to freely inclined may be used.

The wafer W is at first held on the lower face of the wafer holding head 11, when the wafer W is polished with the wafer polishing apparatus 1. Or, the wafer W is at first affixed on the wafer affixing sheet 16*a* (an insert) provided at the lower face of the carrier 16. Then, the surface of the wafer W is allowed to contact the polishing pad Su affixed on the upper face of the platen P, while the periphery of the wafer W is locked with the retainer ring 17.

Subsequently, the pressure in the fluid chamber 24 is adjusted by allowing a fluid such as air to flow in the fluid chamber 24 from the flow path 25, to adjust the pressing pressure of the carrier 16 and the retainer ring 17 onto the polishing pad Su. Since the carrier 16 and the retainer ring 17 has a floating structure being able to independently displace along the ascending and descending directions, respectively, the pressing pressure onto the polishing pad Su is adjustable by the pressure in the fluid chamber 24.

The platen rotates to rotate respective wafer holding heads 11, while adjusting the pressing pressure of the carrier 16 and the retainer ring 17 onto the polishing pad Su. At the same time, the platen P on which the polishing pad Su is affixed is allowed to rotate along the counter-clockwise direction as shown in FIG. 1 to feed the slurry from the nozzle 4.

Since the dress ring 2 is mounted on the polishing pad Su, it is allowed to rotate by the frictional force between the polishing pad Su and the lower face of the dress ring 2. In other words, while the center side portion and the outer side portion of the polishing pad Su suffer different forces acting on the dress ring 2, the polishing pad Su is allowed to rotate by taking advantage of the difference between these forces. For example, when the polishing pad Su is allowed to rotate along the counter-clockwise direction as shown in FIG. 1, the position b1 corresponding to the outer side portion of the polishing pad Su suffers the largest frictional force acting on the dress ring 2. Since the dress ring 2 is supported to be freely rotatable while maintaining its relative position with the ring guide 3, a force along the counter-clockwise direction also acts on the dress ring 2. Consequently, the dress ring rotates together with the rotation of the polishing pad Su, thereby the former rotates along the counter-clockwise direction.

A driving member 3*b* comprising the roller bearings 3*a* and a motor may be coupled with a timing belt 3*c* to allow the dress ring to actively rotate. An auxiliary force is applied to the dress ring 2 by making the roller bearings 3*a* rotatable, thereby making rotation of the dress ring 2 to be smooth. Rotation of a plurality of the roller bearings 3*a* is securely synchronized, by allowing respective roller bearings 3*a* to drive with one driving member 3*b*.

Of course, it is possible to actively rotate the dress ring 2 with the driving member 3*b*. For example, the dress ring 2 is allowed to rotate by providing a gear at the outer circumference of the dress ring 2, as well as a gear at the roller bearing 3*a*, and by being engaged with the gears.

The surface of the polishing pad Su is dressed by the function of the abrasive grain layer formed at the lower end face of the dress ring 2, by allowing each dress ring 2 to rotate.

Polishing of the wafer W and dressing of the polishing pad Su is simultaneously carried out with good efficiency, by providing the dress rings 2 at the individual outside of the plural wafer holding heads 11 as described above.

Since the wafer holding head is disposed in the cylindrical dress ring 2, the space inside of the dress ring 2 is effectively utilized. Consequently, a plurality of the wafer holding heads 11 and the dress rings 2 can be disposed on the polishing pad Su to improve the service efficiency of the overall apparatus.

The polishing pad Su is dressed along with correction of the shape (truing) by disposing a plurality of the dress rings 22 provided with the ring-shaped abrasive grain layer. Although the surface of the polishing pad Su becomes a little rough when the thickness of the polishing pad Su itself is irregular, or when the thickness of the adhesive layer for affixing the polishing pad Su on the platen P is not uniform, the shape is corrected to planarize the surface of the polishing pad Su by using the dress ring 2.

Since the dress ring 2 is mounted on the polishing pad Su, the pressing force on the polishing pad Su is caused by the weight of the dress ring 2. The dress ring 2 rotates by taking advantage of friction between the dress ring and the polishing pad Su, not relying on active means using, for example, various kinds of actuators. Therefore, the contact angle between the dress ring 2 and the polishing pad Su is made to be not so inclined, besides the polishing pad Su is not forcibly polished. Consequently, the polishing pad Su is uniformly dressed without being excessively polishing the surface of the polishing pad Su.

It is also possible to provides a plurality of nozzles for feeding the slurry to the gaps at the peripheries of each wafer holding head 11. Since the slurry is maintained by the dress ring 2, while the polishing pad Su is rotating, by feeding the slurry to the gap 6, the slurry never flows out to the outside along the radial direction due to centrifugal force. Accordingly, consumption of the slurry can be reduced. In addition, since the slurry is directly fed to the periphery of the wafer W to be polished, polishing of the wafer Wand dressing of the polishing pad Su are effected with a low cost.

It is also possible to provide a through-hole at a part of the circumference wall of the dress ring 2. The fresh abrasive fed from the nozzle 4 replaces the denatured abrasive, or the slurry containing polishing debris in a given proportion, since the through-hole formed serves as an output for the slurry accommodated in the gap 6, enabling degradation of the slurry to be prevented.

Second Embodiment

Figure 4:
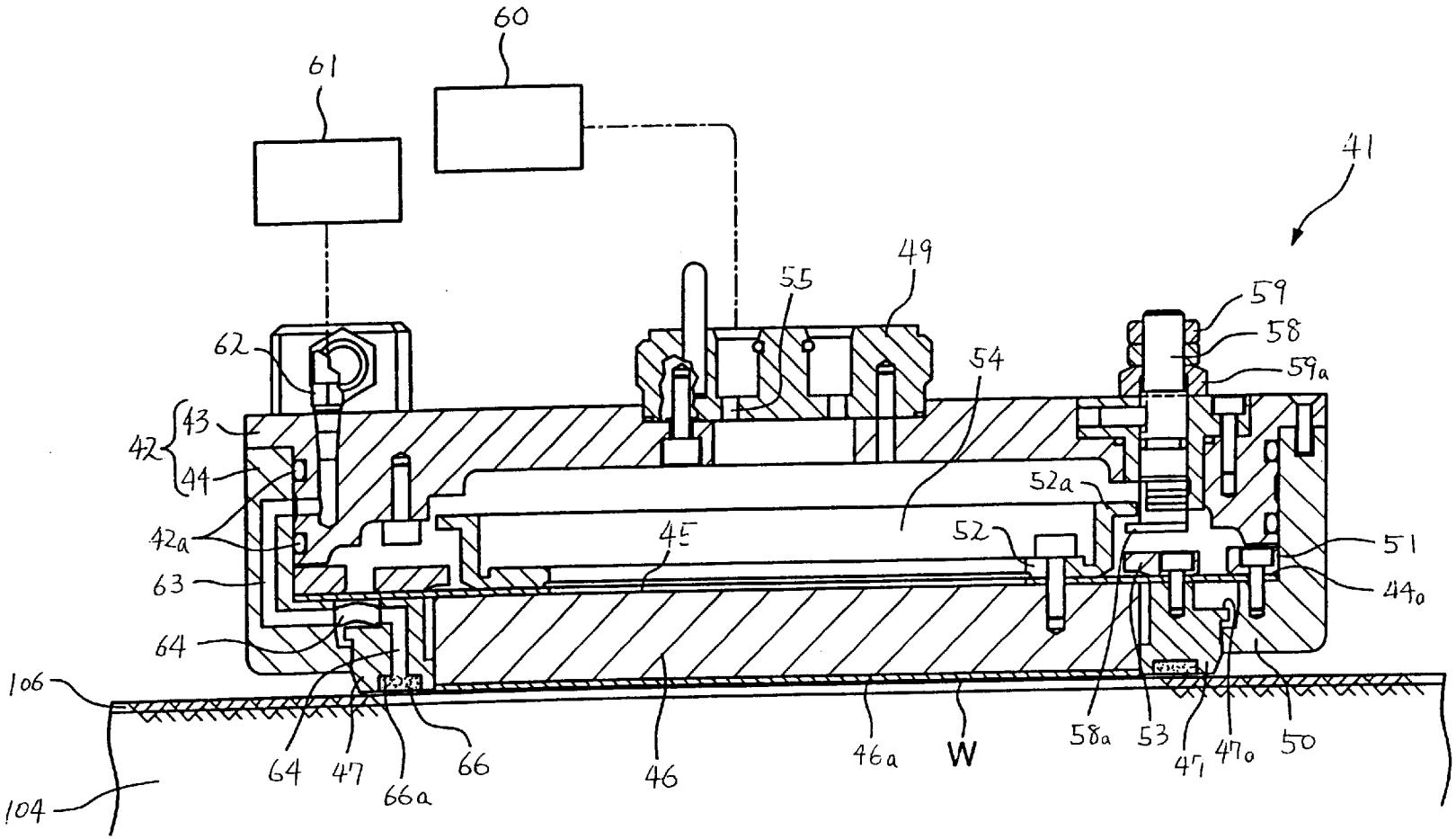
FIG. 4 shows a cross section showing the second embodiment of the wafer polishing apparatus according to the present invention.

The second embodiment of the present invention will be described hereinafter with reference to the drawings. FIG. 4 shows a cross section of a wafer holding head 41 of the wafer polishing apparatus in the second embodiment of the present invention.

Figure 6:
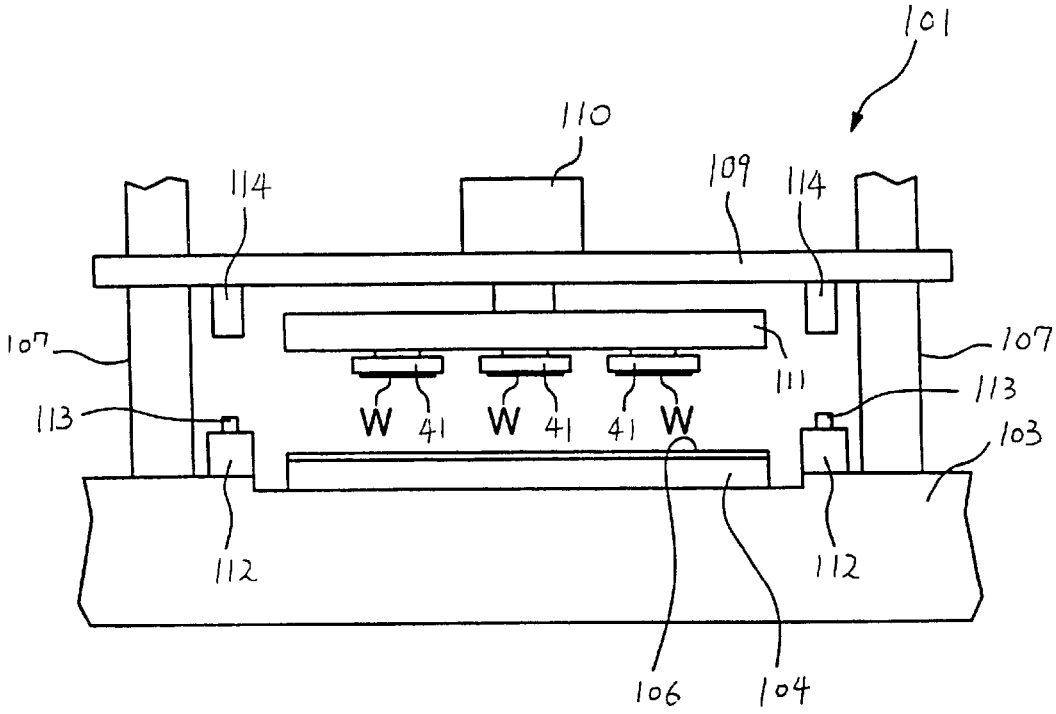
FIG. 6 shows an overall drawing of the wafer polishing apparatus as the second and third embodiments of the present invention.
Figure 7:
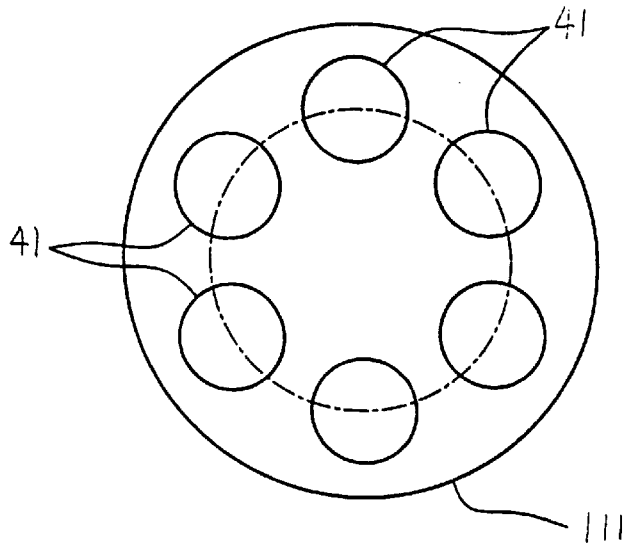
FIG. 7 is an illustrative drawing of the disposition of the wafer holding head in the wafer polishing apparatus in the second and third embodiments of the present invention.

A plurality of the wafer holding heads 41 are mounted on a carousel 111 as a head driving mechanism in the overall wafer polishing apparatus shown, for example, in FIGS. 6 and 7. The wafer holding mechanism undergoes a planetary motion on the polishing pad 106 affixed on the entire surface of the upper face of the platen 104 formed into a disk shape.

In FIG. 6, the platen 104 is horizontally disposed at the center of a base 103, is allowed to rotate around the axis line with a platen driving mechanism provided in the base 103. Any materials that have been conventionally used for polishing the wafer may be used for the polishing pad 106 affixed on the surface of the platen 104, examples of them including a velour type pad prepared by impregnating a nonwoven fabric comprising polyester with a soft resin such as polyurethane, a suede type pad prepared by forming a resin foam layer comprising polyurethane foam on a substrate such as a polyester nonwoven fabric, or a resin foam sheet comprising independently foamed polyurethane.

Guide posts 107 are provided at the side of the base 103, and an upper mounting plate (bridge) 109 is disposed on the guide posts. The upper mounting plate (bridge) 109 supports a carousel driving mechanism 110, and a carousel 111 is provided at below the carousel driving mechanism 110. The carousel driving mechanism 110 serves for rotating the carousel 111 round the axis line.

Bridge supports 112 are disposed so as to protrude upward from the base 103. A gap adjustment mechanism 113 is provided on the upper end of the bridge support 112. A locking member 114 is disposed in an opposite relation to the bridge support 112 above the bridge support 112. The locking member 114 is fixed to the upper mounting plate (bridge) 109, and protrudes downward from the upper mounting plate (bridge) 109. The distance between the wafer holding head 41 holding the wafer W and the polishing pad 106 is appropriately adjusted by adjusting the gap adjustment mechanism 113 and by allowing the bridge support 112 to contact the locking member 114.

In total six wafer holding heads 41 in an opposed relation to the platen 104 are provided on the lower face of the carousel 111. The wafer holding heads 41 are disposed at every 60 around the center axis of the carousel 111 with an equal distance apart from the center of the carousel 111 as shown in FIG. 7. Each wafer holding head 41 is allowed to rotate with a head driving mechanism (not shown) along the circumference direction, besides undergoing a planetary motion with the carousel driving mechanism 110. The center of the platen 104 and the center of revolution of the wafer holding head 41 may be eccentric with each other.

The wafer holding head 41 will be described hereinafter.

As shown in FIG. 4, the wafer holding head 41 is provided with a head body 42 comprising a top plate 43 and a cylindrical circumference wall, a diaphragm 45 expanded in the head body 42, a disk-shaped carrier 46 fixed on the lower face of the diaphragm 45, and a ring-shaped retainer ring 47 provided in a concentric relation to the inner face of the circumference wall 44 and the circumference face of the carrier 46.

The head body 42 is composed of the disk-shaped top plate 43 and the cylindrical circumference wall 44 fixed at below the outer circumference of the top plate 43, and the lower end of the head body 42 has an hollow opening. The top plate 43 is coaxially fixed to a shaft 49, in which a flow path 45 communicating with a pressure adjusting mechanism 60 is formed along the vertical direction. A step 44*a* and a locking member 60, protruding toward the inside along the radial direction, are formed on the lower end of the circumference wall 44 over the entire circumference.

The diaphragm 45 comprising an elastic material such as a fiber reinforced rubber is formed into a ring-shape or a disk-shape, and is fixed with a diaphragm fixing ring 51 on the step 44*a* formed on the inner wall of the circumference wall 44.

A fluid chamber 54 is formed at the upward of the diaphragm 45, and communicates with the flow path 55 formed in the shaft 49. The pressure in the fluid chamber 54 is adjusted by feeding a fluid such as air from the pressure adjusting mechanism 60 through the flow path 55.

The carrier 46 comprising a highly rigid material such as a ceramic is formed into a disk with an approximately constant thickness, and is fixed with a carrier fixing ring 52 provided on the upper face of the diaphragm 45. A ring-shaped step 52*a* is formed on the upper part of the carrier fixing ring 52, and the step engages with a step 58*a* formed at the lower end of stopper bolts 58, which vertically penetrate through the top plate 43, and are fixed with nuts 59 and spacers 59*a*. Consequently, the diaphragm 45 does not suffer an excess force by allowing the step 52*a* to engage with the step 58*a*, even when the diaphragm 45 is bent downward by the weight of the carrier 46 by allowing the wafer holding head to ascend.

The retainer ring 47 is formed into a ring shape between the inner wall of the circumference wall 44 and the outer circumference face of the carrier 46, and is disposed in a concentric relation to the circumference wall 44 and the carrier 46 with a slight gap between the inner wall of the circumference wall 44 and the outer circumference face of the carrier 46. The retainer ring 47 is fixed with a retainer ring fixing ring 53 provided on the upper face of the diaphragm 45. The upper end face and the lower end face of the retainer ring 47 is formed to be horizontal. A step 47*a* is formed on the outer circumference face of the retainer ring 47, which prevents the retainer ring 47 from being excessively displaced by allowing the step 47*a* to engage with the locking member 10 when the wafer holding head 41 ascends, thereby the diaphragm 45 does not suffer a local force.

A joint 62 for coupling with a slurry feed member 61 is provided at the top plate 43 of the head body 42. A head body tube 63, which is formed along the vertical direction in the top plate 43 and communicate with the circumference wall 44, is formed from the joint 62. An O-ring 42*a* is provided between the top plate 43 and the circumference wall 44 to allow the top plate 43 to securely contact the circumference wall 44.

The lower end of the head body tube 63 is formed so as to penetrate toward the inner circumference side of the circumference wall 44, and coupled with one end of a flexible tube 64. The flexible tube 64 is made of an elastic material such as a rubber tube, and the end of the tube communicates with a retainer ring tube 65 formed in the retainer ring 47.

The retainer ring 65 is provided so that the tube penetrates through the outer circumference and lower face of the retainer ring, and a slurry pocket 66 is formed at the lower end side. The slurry pocket 66 communicates with the retainer ring tube 65, and is formed into a ring-shaped groove that crawls along the lower face of the retainer ring and is open at the polishing pad 106 side. The slurry fed from the slurry feed member 61 flows into the slurry pocket 66 through the head body tube 63, flexible tube 64 and retainer ring tube 65.

When the wafer W is polished using the wafer holding head 41 as described above, the wafer W is at first affixed on a wafer affixing sheet 6*a* (an insert). Then, the surface of the wafer W is allowed to contact the polishing pad 106 affixed on the upper face of the platen 104, while the periphery of the wafer W is locked with the retainer ring 47. The lower face of the retainer ring 47 provided with the slurry pocket 66 is also allowed to contact the polishing pad 106.

Subsequently, the pressure in the fluid chamber 54 is adjusted by allowing a fluid such as air to flow in the fluid chamber 54 from the flow path 55, to adjust the pressing pressure of the carrier 46 and the retainer ring 47 onto the polishing pad 106. Since the carrier 46 and the retainer ring 47 has a floating structure being able to independently displace along the ascending and descending directions by being supported with the diaphragm 45, the pressing pressure onto the polishing pad 106 is adjustable by the pressure in the fluid chamber 54.

The platen 104 is allowed to rotate while allowing the wafer holding head 41 to undergo a planetary motion, by adjusting the pressing pressure of the carrier 46 and the retainer ring 47 onto the polishing pad 106.

During the process described above, the slurry is fed from the slurry feed member 61 to the head body tube 63. The slurry flows into the slurry pocket 66 through the head body tube 63, flexible tube 64, and retainer ring 65. Since the opening side of the slurry pocket 66 is blocked with the polishing pad 106, the slurry is equally distributed along the ring-shaped groove of the slurry pocket 66.

The slurry is fed from the slurry pocket 66 onto the surface of the polishing pad 106, by allowing the wafer holding head 41 to rotate. The surface of the wafer W is polished after the slurry has been fed onto the polishing face of the wafer W.

The polishing face of the wafer W is efficiently polished, since the slurry is directly fed from the slurry pocket 66 formed around the wafer W. The slurry pocket 66 is formed into a ring-shaped groove on the lower face of the retainer ring 47 making contact with the surface of the polishing pad 106. Accordingly, the slurry never flows out along the radial direction even when the polishing pad 106 affixed on the platen 104, and the wafer holding head 41 itself rotate, because the slurry is held in the slurry pocket 66, thereby making it possible to efficiently polish the wafer with a minimum consumption of the slurry. Since the wafer holding head 41 itself is rotating, the slurry can be evenly fed onto the surface of the polishing pad 106, allowing the slurry to exhibit an efficient polishing function.

While some of the polishing debris generated by polishing is stirred with the slurry in the slurry pocket 66 by rotation of the wafer holding head 41 and the polishing pad 106, the polishing debris affixed on the polishing pad 106 is efficiently removed with, for example, pH controlled water supplied at around the center of the polishing pad 106.

It is also possible to remove the polishing debris using only water the pH of which has not been controlled, or a diluted abrasive, to reduce consumption of expensive abrasive.

The slurry is fed without inhibiting displacement of the retainer ring along the axis line direction, thus allowing secure polishing, by communicating the head body tube 63 with the retainer ring 65 using the flexible tube 64 comprising an elastic material.

While the slurry pocket 66 in this embodiment is provided so that its upper face 66*a* lies parallel to the lower face of the retainer ring 47 as shown in FIG. 4, a step may be provided between the carrier 46 side and the circumference wall 44 side. For example, lowering the carrier 46 side of the upper face 66*a* is effective for feeding a larger amount of the slurry to the wafer W side, because the slurry in the slurry pocket 66 tends to easily flow into the wafer W side. Lowering the circumference wall 44 side of the upper face 66*a* is effective, on the other hand, for preferentially remove the polishing debris, because the slurry tends to easily flow out.

Third Embodiment

The wafer holding head 71 according to the third embodiment of the present invention will be described hereinafter with reference to the drawings.

Figure 5:
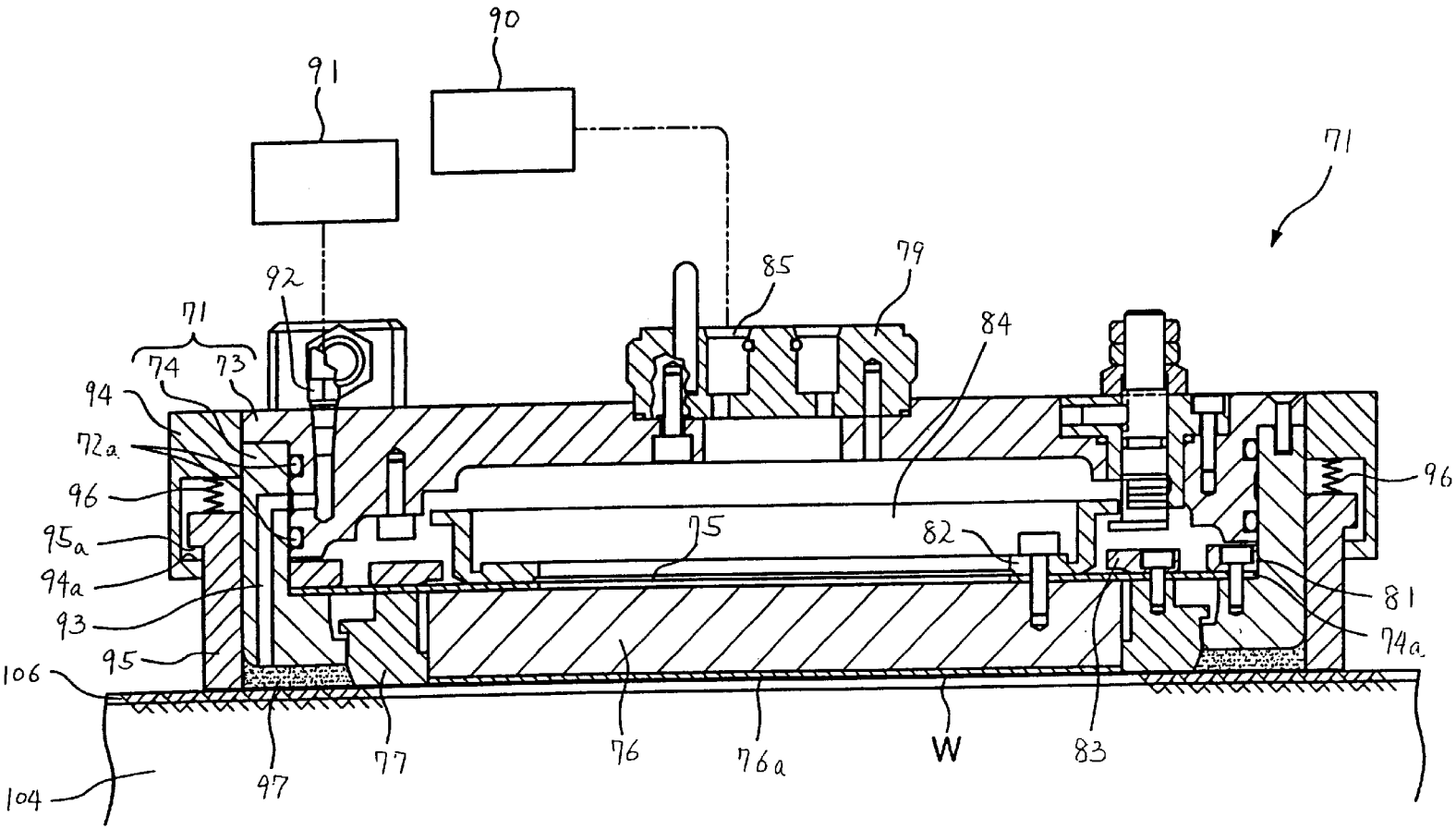
FIG. 5 shows a cross section showing the third embodiment of the wafer polishing apparatus according to the present invention.

A plurality of the wafer holding heads 71 shown in FIG. 5 in the overall drawing of the wafer polishing apparatus 101 in, for example, FIG. 6 are provided under the carousel 111 as a head driving mechanism, and they undergo a planetary motion on the polishing pad 106 affixed on the platen 104.

In FIG. 5, the wafer holding head 71 is provided with a head body 72 comprising a top plate 73 and a cylindrical circumference wall 74, a diaphragm 75 comprising an elastic material such as a fiber reinforced rubber expanded in the head body 72, a carrier 76 fixed at the lower face of the diaphragm 75, and a ring-shaped retainer ring 77 provided in a concentric relation to the inner wall of the circumference wall 74 and the circumference face of the carrier 76.

A flow path 85 communicating with the pressure adjustment mechanism 90, which also communicates with a fluid chamber 84, is formed along the vertical direction in the shaft 79 for coupling to the carousel 111. The diaphragm 75 is fixed to a step 74*a* formed at the lower end of the circumference wall 74 with a diaphragm fixing ring 81.

The disk-shaped carrier 76 is fixed with a carrier fixing ring 82 via the diaphragm 75, and the ring-shaped retainer ring 77 is fixed with a retainer ring fixing ring 83.

A head body tube 93 communicates with a joint 92 coupled to a slurry feed member 91. The head body tube 93 is vertically formed toward downward through the top plate 73 to a midway height, extends toward the circumference wall 74, and finally penetrates through an approximately mid point of the circumference wall 74 toward the lower face of the circumference wall 74. The top plate 73 and the circumference wall 74 is coupled via a O-ring 72*a*.

A ring-shaped outer ring supporting member 94 is provided at the outside of the head body 72. The upper part of the outer ring supporting member 94 is fixed to the side wall of the top plate 73, and the lower part of the outer ring supporting member 94, positioned at a mid-height at the outside of the circumference wall 74, is formed to have a L-shaped cross section bent toward the inside to form a step 94*a*.

A ring-shaped outer ring 95 is provided in the inner space of the outer ring supporting member 94. The outer ring 95 is coupled to the inner space of the outer ring supporting member 94 with an outer ring press member 96 comprising an elastic material such as a spring, and is supported to be able to displace along the ascending and descending direction.

A step 95*a* protruding to the outside is formed at the upper part of the outer ring 95. The step 94*a* of the outer ring supporting member 94 serves for enhancing the wafer holding head 71 to move downward, when it ascends by means of an ascending-descending mechanism 108.

The lower face of the outer ring 95 contacts the surface of the polishing pad 106, in order to form a slurry pocket 97 utilizing the inner circumference face of the outer ring 95, the outer circumference face of the retainer ring 77, and the lower face of the circumference wall.

When the wafer W is polished using the wafer holding head 71 constructed as described above, the wafer W is affixed on a wafer affixing sheet 76*a* (an insert) provided on the lower face of the carrier 76 and is locked with the retainer ring 77. Then, the surface of the wafer W is allowed to contact the polishing pad 106 affixed on the upper face of the platen 104. The pressing force of the carrier 76 and the retainer ring 77 onto the polishing pad 106 is adjusted by adjusting the pressure in the fluid chamber 84.

The platen 104 is allowed to rotate while the wafer holding head 71 is allowed to undergo a planetary motion. The slurry flows through the head body tube 93 from the slurry feed member 91 to feed it in the slurry pocket 97.

Since the retainer ring 77 and the outer ring 95 have a floating structure by which they are able to displace along the axis direction, their lower faces can securely come in contact with the polishing pad 106.

The slurry is fed onto the surface of the polishing pad 106 from the slurry pocket 97, by allowing the wafer holding head 71 to rotate to polish the wafer W. The slurry is efficiently fed onto the polishing face of the wafer W, since the slurry is directly fed from the slurry pocket 97 formed in the periphery of the wafer W.

The slurry pocket 97 is surrounded by the outer ring 95, the retainer ring 77 and the circumference wall 74, and the retainer ring 77 and the outer ring 95 have a floating structure, respectively, by which the retainer ring 77 and the outer ring 95 are able to displace along the ascending and descending directions by means of the diapliragm 75 and the outer ring press member 96. Accordingly, the lower faces of them securely contact the polishing pad 106. Consequently, the slurry does not flow out in a large amount due to centrifugal force even when the wafer holding head 71 itself rotates, since the slurry is retained in the slurry pocket 97. The slurry is evenly fed onto the surface of the polishing pad 106 by rotation of the wafer holding head 71, allowing the slurry to efficiently exhibit polishing effect.

The polishing debris generated by polishing is mixed with there abrasive in the slurry pocket 97 that is stirred by rotation of the wafer holding head 71, thus allowing the polishing debris to be efficiently removed from the surface of the polishing pad 106. Although the polishing debris has been flowed out using a large amount of the slurry in the related art, it is removable by using the slurry, or a solution of the slurry, or a diluted abrasive in the present invention, thereby making it possible to save consumption of the expensive abrasive.

It is naturally possible to provide the slurry pocket on the lower face of the retainer ring 77 of the wafer holding head 71. The construction described above allows tie slurry to be fed into the slurry pocket formed on the lower face of the retainer ring 77, and into the slurry pocket 97, formed between the retainer ring 77 and the outer ring 95 by providing the outer ring 95 at the outside of the head body 72, to reduce the amount of the flowing out abrasive, thereby saving the amount of the waste abrasive.

Fourth embodiment

The wafer polishing apparatus according to the fourth embodiment of the present invention of the present invention will be described hereinafter with reference to FIGS. 8 and 9.

Figure 8:
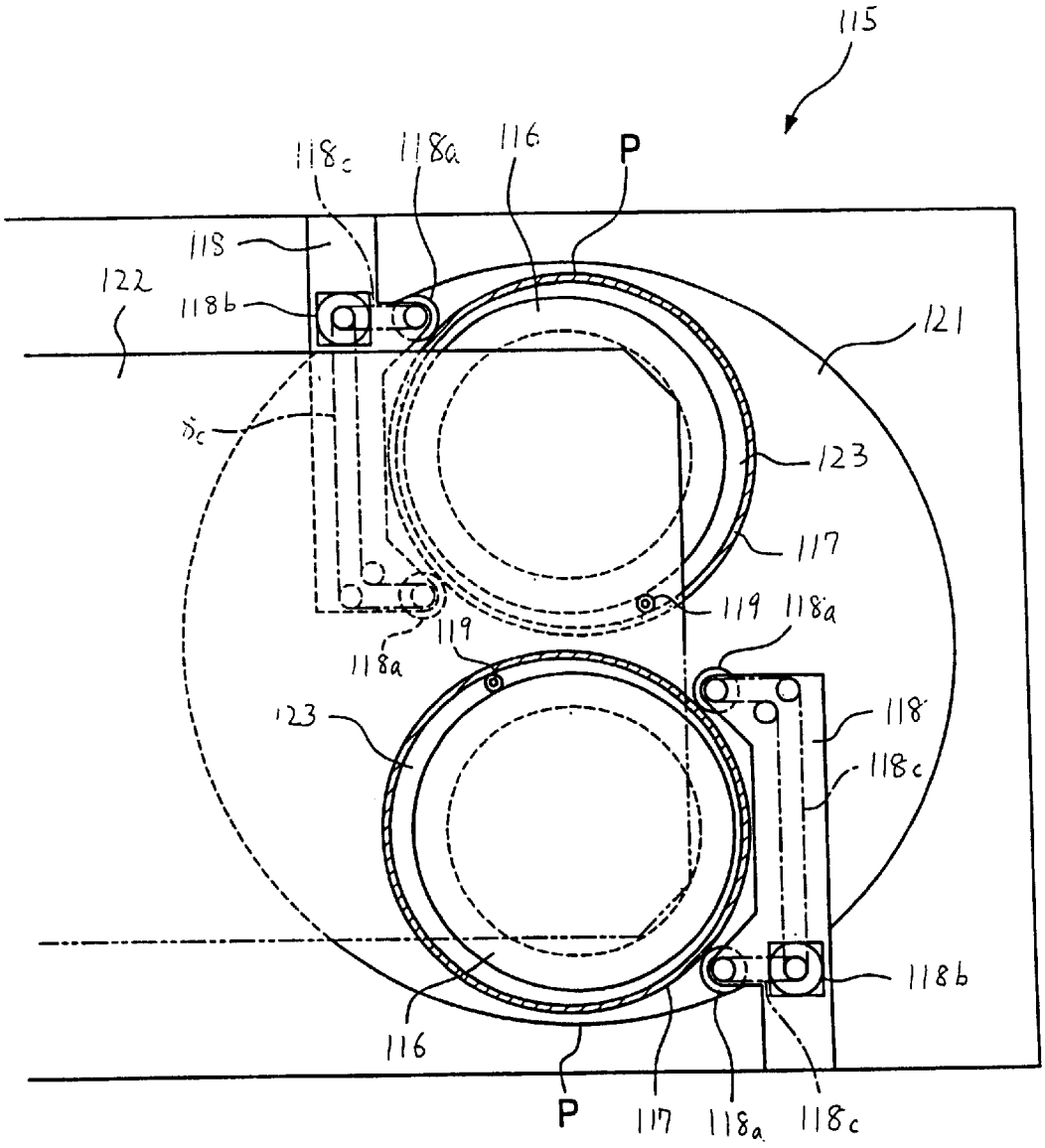
FIG. 8 shows a plane view viewed from upward of the wafer polishing apparatus in the fourth embodiment of the present invention.
Figure 9:
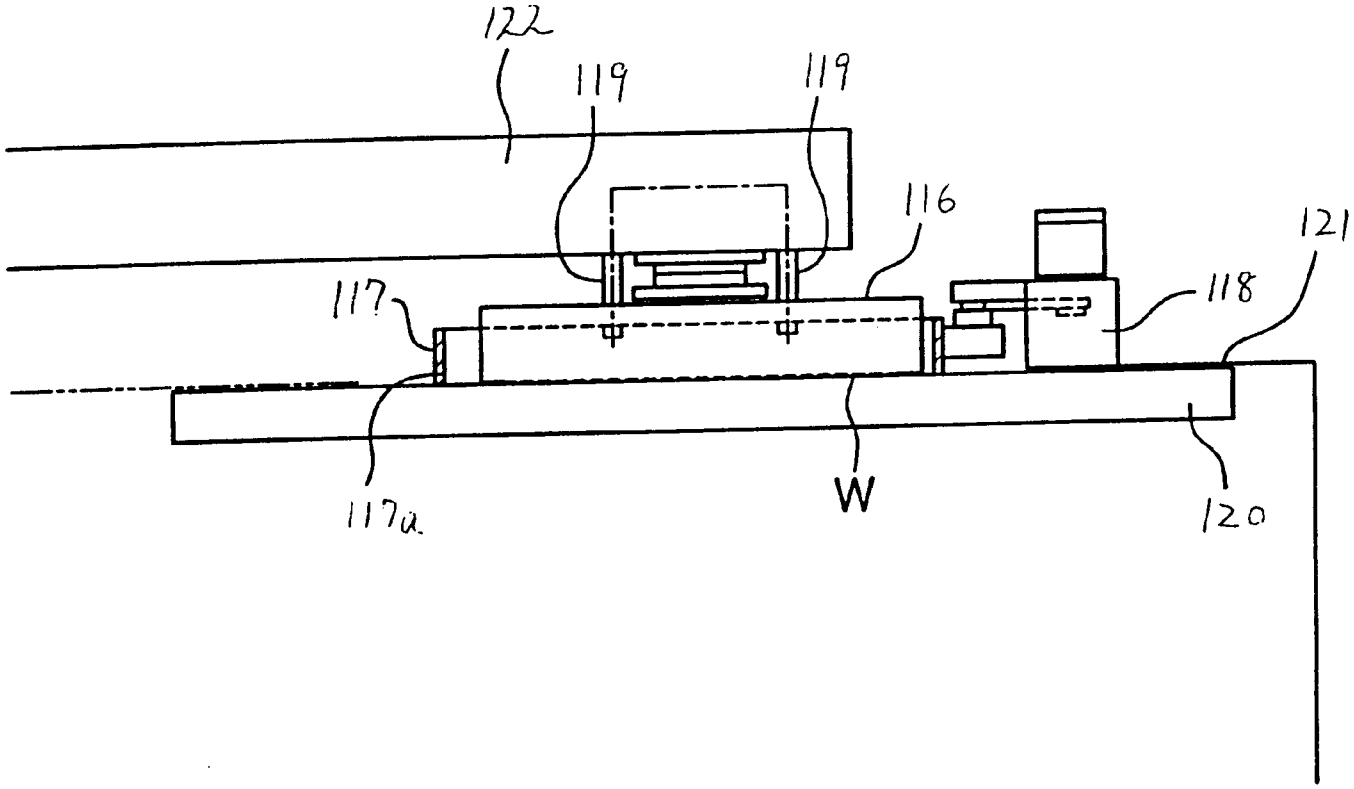
FIG. 9 shows a side view of the wafer polishing apparatus in FIG. 8.
Figure 20:
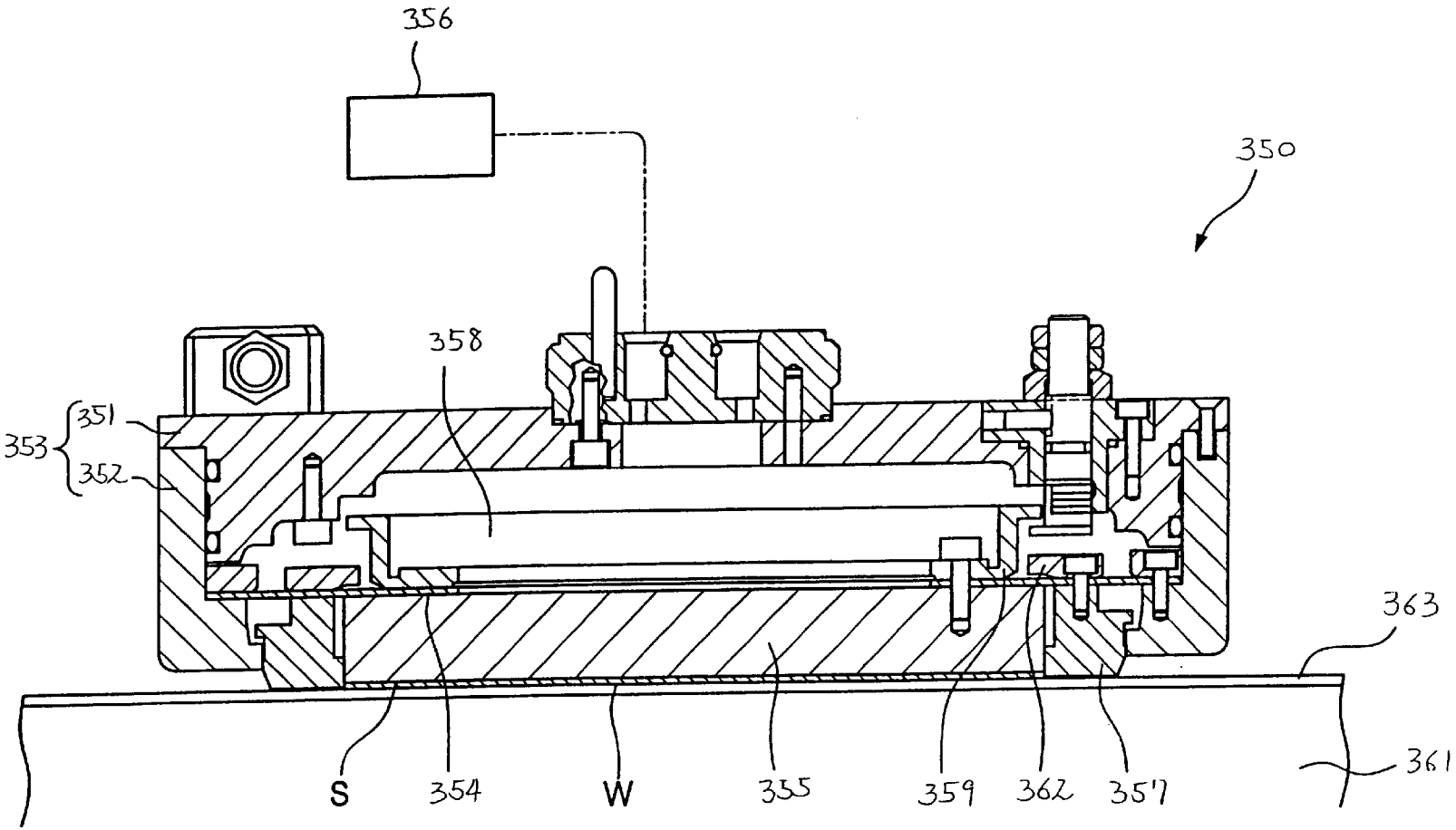
FIG.20 (PRIOR ART)
FIG. 20 illustrates the wafer holding head to be used in the conventional wafer polishing apparatus.

In FIGS. 8 and 9, the wafer polishing apparatus 115 is provided with a wafer holding head 116, a slurry holding ring 117 provided at the outside of the wafer holding head 116, a ring guide 118 for supporting the slurry holding ring 117, and a slurry feed member 119. The wafer holding head 116 as shown, for example, in FIG. 20 may be used.

The wafer holding heads 116, two in this embodiment, are supported on the base 122 in a freely rotatable manner. The wafer W supported with the wafer holding heads 116 makes contact with the surface of a polishing pad 121 affixed on a rotating platen 120.

The ring-shaped slurry holding ring 117 provided at outside of the wafer holding heads 116 is formed to have a diameter larger than the outer diameter of the wafer holding heads 116 and smaller than the radius of the polishing pad 121 with a gap 123 from the wafer holding heads 116. The lower end face of the slurry holding ring 117 makes contact with the surface of the polishing pad 121.

The slurry holding ring 117 is mounted on the polishing pad 121, and is allowed to rotate by the frictional force between the polishing pad 121 and the slurry holding ring 117 generated by rotation of the platen 120. The ring guide 118 supporting the slurry holding ring 117 is provided with two roller bearings 118*a*, which support the slurry holding ring 117 so as not to inhibit rotation of the slurry holding ring 117.

A slurry feed member 119, for feeding the slurry to the gap 123 formed between the slurry holding ring 117 and the wafer holding head 116, is provided on the base 122. The tubular abrasive feed member 119 is disposed at two sites for feeding the slurry to respective gaps 123 with its tip in a space apart from the polishing pad 121.

An outlet 117*a* as a penetration hole is formed at the lower part of the side wall of the retainer holding ring 117, for replacing the slurry accommodated in the gap 123 with the fresh abrasive fed from the slurry feed member 119. The outlet 117*a* is formed at a little above the lower end of the slurry holding ring 117, and is allowed to contact the polishing pad 121 while maintaining a ring-shape of the abrasive grain layer provided at the lower end of the slurry holding ring 117.

When the wafer W is polished with the wafer polishing apparatus 115 as hitherto described, the wafer W is at first held on the lower face of the wafer holding head 116. The polishing face of the wafer W is allowed to contact the polishing pad 121 while the wafer holding head 116 is rotating. The platen 120 on which the polishing pad 121 is affixed is allowed to rotate along the counter-clockwise direction as shown in FIG. 8 to feed the slurry into the gap 123 from the slurry feed member 119.

The slurry holding ring 117 is mounted on the polishing pad 121, and is allowed to rotate by frictional force between the rotating polishing pad 121 and the slurry holding ring 117. In other words, since the forces acting on the slurry holding ring 117 are different between the portions at around the center and at the outside of the polishing pad 121, the slurry holding ring 117 is allowed to rotate by taking advantage of the difference between the tow forces described above. For example, when the polishing pad 121 is allowed to rotate along the counter-clockwise direction as shown in FIG. 8, the portion having the largest frictional force acting on the slurry holding ring 117 corresponds to the position P at the outside of the polishing pad 121. Since the slurry holding ring 117 is supported by the ring guide 118 in a rotatable manner while maintaining its relative position, a force along the counter-clockwise direction also acts on the slurry holding ring 117. Consequently, the slurry holding ring 117 is allowed to rotate along the counter-clockwise direction so as to be engaged with rotation of the polishing pad 121.

Respective roller bearings 118*a* may be coupled with a driving mechanism 118*b* with a timing belt 118*c* for allowing the slurry holding ring to actively rotate. The slurry holding ring 117 smoothly rotates by receiving an auxiliary force by making the roller bearings 118*a* to be rotatable. Synchronized rotation of a plurality of the roller bearings 118*a* is secured by allowing respective roller bearings 118*a* to drive using one driving mechanism 118*b*.

The slurry fed into the gap 123 is prevented from flowing out by means of the slurry holding ring 117. The wafer W is polished while being fed with the slurry, by allowing the wafer holding head 116 provided in the slurry holding ring 117 to rotate. The slurry holding ring 117 does not change the relative position between the polishing pad 121 and the wafer holding head 116, since the slurry holding ring 117 simultaneously rotates, thereby the slurry in the gap is securely maintained.

The slurry is efficiently fed from around the wafer holding head 116, by providing the slurry holding ring 117 at the outside of the wafer holding head 116 to feed the slurry into the gap 123 formed between the wafer holding head 116 and the slurry holding ring 117. Since the slurry is prevented from flowing out by the slurry holding ring 117 even when the polishing pad 121 is rotating, consumption of the slurry is saved to enable the wafer W to be efficiently polished with a low cost.

The polishing debris generated by polishing is removed by being mixed with the slurry accommodated in the gap 123. The polishing debris can be removed by merely feeding the soluble portion of the slurry from the slurry feed member 119 to save the slurry.

The degraded slurry in the gap 123, or the slurry containing the polishing debris is replaced with the fresh abrasive fed from the slurry feed member 119, by providing an outlet 117*a* in the slurry holding ring 117, thereby allowing denaturation of the slurry to be prevented.

Since the slurry holding ring 117 is mounted on the polishing pad 121, a pressing pressure is applied on the polishing pad 121 by the weight of the slurry holding ring 117. Rotation of slurry holding ring 117 takes advantage of the frictional force between the slurry holding ring 117 and the polishing pad 121. For example, since the slurry holding ring 117 is allowed to rotate not depending on an active method using a various kinds of actuators, the contact angle between the slurry holding ring 117 and the polishing pad 121 is adjusted not to be so extremely inclined. Therefore, the polishing pad 121 is prevented from suffering a local pressing pressure due to the slurry holding ring 117 to prevent the polishing pad 121 from being damaged.

It is also possible to provide an abrasive grain layer on the lower end face of the slurry holding ring 117, in order to endow the polishing pad 121 with a dressing function. Polishing of the wafer W and dressing of the polishing pad 121 may be simultaneously carried out by allowing the slurry holding ring 117 to have a dressing function, thereby making it possible to shorten the manufacturing process. In addition, the slurry is directly fed from the periphery of the wafer W to enable efficient polishing while suppressing the slurry from flowing out, by directly feeding the slurry into the gap 123 between the slurry holding ring 117 and the wafer holding head 116.

Since the slurry holding ring 117 provided with the abrasive grain layer is mounted on the polishing pad 121, the contact angle to the polishing pad 121 is adjusted so that the angle is not so remarkably inclined, besides preventing the polishing pad 121 from being forcibly polished. Therefore, the surface of the polishing pad 121 is not excessively polished to enable a uniform dressing.

The embodiments as set forth above is not necessarily limited to polishing of the wafer W, but may be applied to a variety of polishing objects such as a hard disk substrate that require a mirror polishing finish.

Fifth Embodiment

Figure 10:
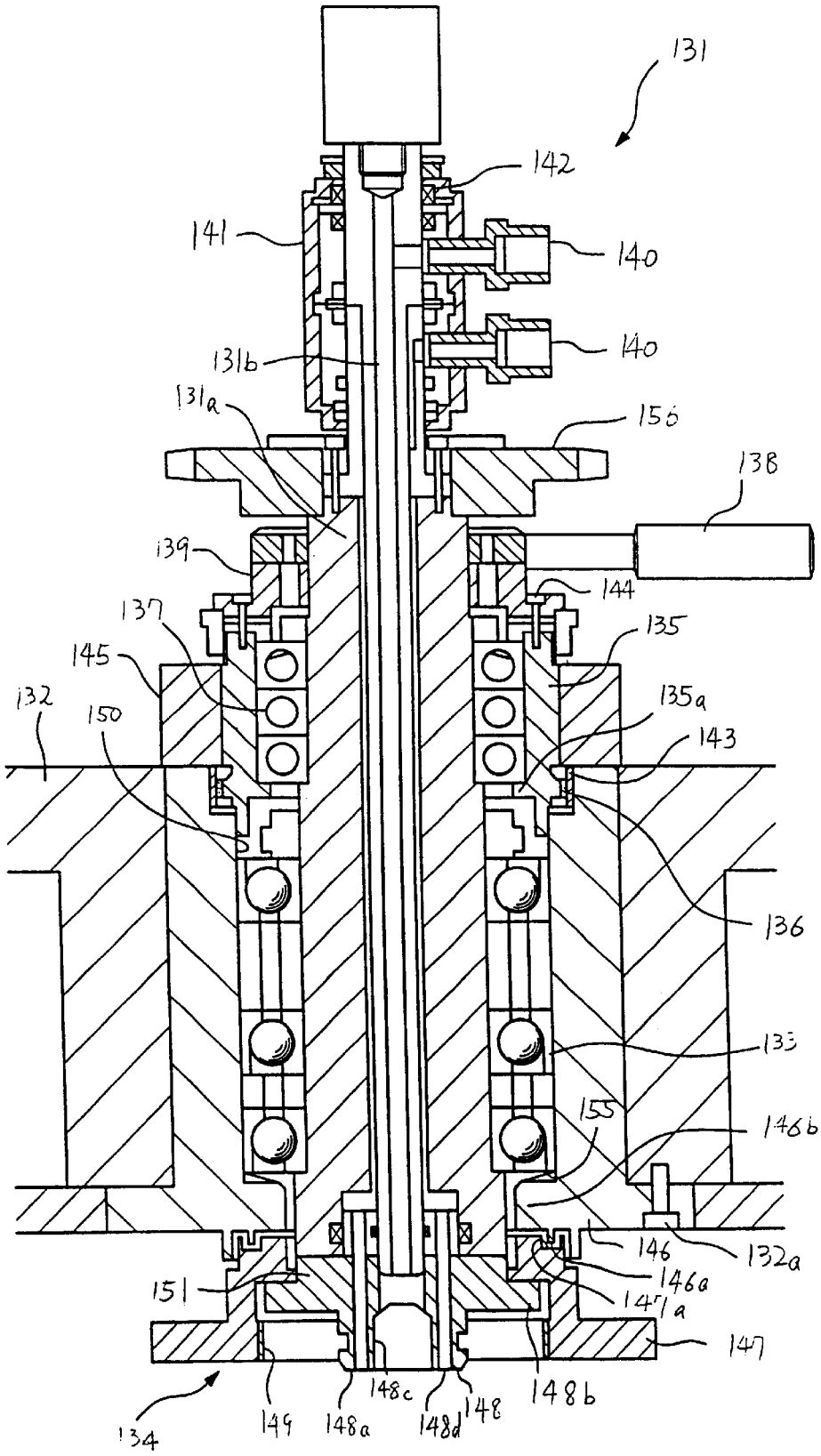
FIG. 10 shows a cross section of the spindle of the wafer polishing apparatus in the fifth embodiment of the present invention.

The wafer polishing apparatus and the method for manufacturing the wafer according to the fifth embodiment of the present invention will be described hereinafter with reference to the drawings. FIG. 10 shows a cross section of a spindle 131 in the wafer polishing apparatus.

Figure 21:
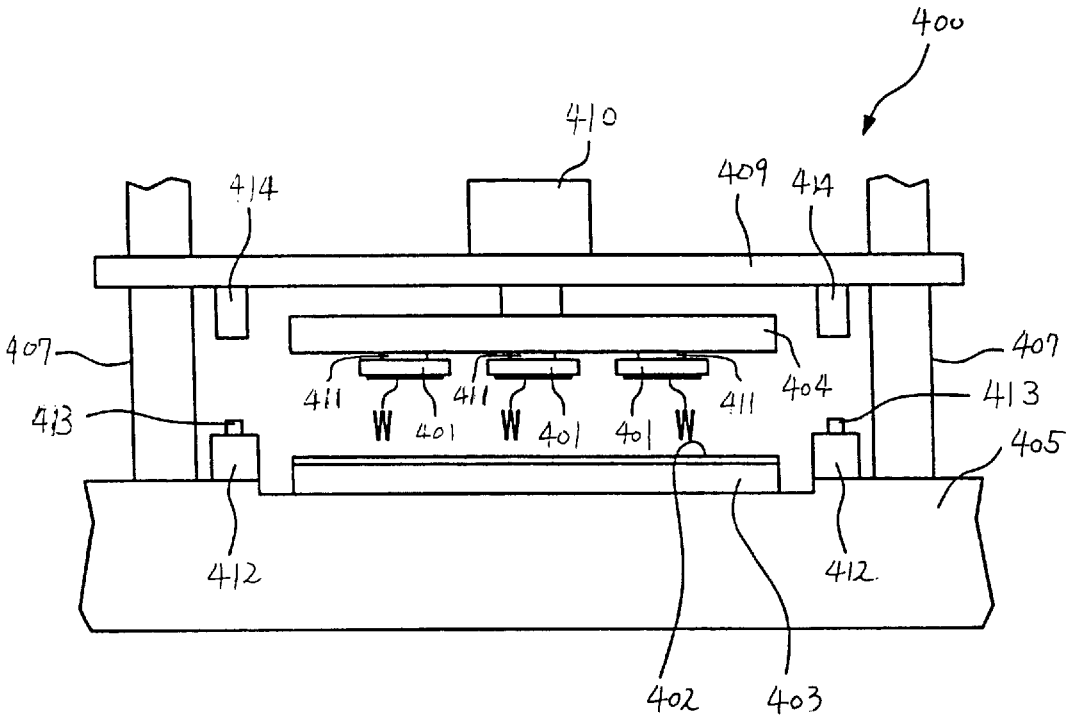
FIG. 21 illustrates the conventional wafer polishing apparatus that is a wafer polishing apparatus to which the fifth embodiment of the present invention is applied.

The spindle 131 is provided at the coupling portion between the carousel (spindle supporting member) and the wafer holding head as shown in FIG. 21.

In FIG. 10, the spindle 131 is provided within the engage member 150 as a penetration hole formed in the spindle housing 146 provided through the carousel 132. The spindle 131 is provided with a main shaft 131 approximately formed into a cylinder, a spindle side coupling member 134 disposed at the lower part of the carousel 132, a handle supporting member 139 disposed at the upper part of the carousel 132, a positioning handle 138 provided so as to extend toward the horizontal direction from the handle supporting member 139, and a fluid feed port 140 communicating with the tube 131*b* of the main shaft 131*a* provided at tie upper end. A first bearing 133 is provided in the engage member 150, and the main shaft 131*a* is supported with the first bearing 133 to be freely rotatable. A flange 145 is provided on the upper face of the carousel 132. The spindle 131 is coupled with the carousel 132 by fixing screws 132*a*.

The first bearing 133 is fitted into the cylindrical engage member 150 formed in the spindle housing 146. The first bearing 133 is supported in the engage member 150 so as to be freely slidable, and the outer circumference of the first bearing 133 and the inner circumference of the engage member 150 is not fixed. The first bearing 133 is provided so that the relative position against the main shaft 131*a* does not change along the axis line direction.

A ring shape hillock 146*a* is formed toward downward along the vertical direction on the lower face of the spindle housing 146. A disk-shaped locking member 146*b* is formed by protruding along die radial direction at the lower part of the inner circumference of the first bearing 133, and restricts the first bearing 133, supported to be freely slidable, from moving downward. A ring-shaped leaf spring 155 may be provided on the upper face of the locking member 146*b* to relax the impact applied with the leaf spring 155 when the lower part of the first bearing 133 comes in contact with the locking member 146*b*.

A bearing supporting member 135 is provided in the upper side flange 145 formed into a cylinder, and a positioning external thread 136 is formed on the outer circumference face of the cylinder. The positioning external thread 136 is screwed into the positioning internal thread 143 formed at the upper part of the inner circumference face of the spindle housing 146. The width of the positioning internal thread 143 along the axis line direction is formed to be larger than the width of the positioning external thread 136 along the axis line direction. The outer circumference face of the bearing supporting member 135 makes a contact with the inner circumference face of the upper side flange 145, and the bearing supporting member 135 is rotatable in the upper side flange 145.

A second bearing 137 is provided in the cylindrical bearing supporting member 135, and the main shaft 131*a* is supported with the second bearing 137 and the first bearing 133 to be freely rotatable. A step 135*a* is formed at the lower end of the bearing supporting member 135 so as to support the second bearing 137 from below. The outer circumference of the second bearing 137 is fixed to the inner circumference of the bearing supporting member 135. The second bearing 137 comprises an angular ball bearing, which restricts movement of the main shaft 131*a* along the axis line direction (thrust direction). Accordingly, the relative position between the main shaft 131*a* and the second bearing 137 does not change.

A cylindrical handle supporting member 139 is provided at the upward of the bearing supporting member 135. The handle supporting member 139 is fixed to the bearing supporting member 135 with bolts 144, and is connected to a positioning handle 138 provided so as to extend along the horizontal direction. The main shaft 131*a* is freely rotatable in the cylindrical handle supporting member 139. The main shaft 131*a* is allowed to travel along the axis line direction by allowing the handle supporting member 139 to turn together with the bearing supporting member 135 using the positioning handle 138.

The bearing supporting member 135, the handle supporting member 139 and the second bearing 137 are fixed with each other, while the first bearing 133 is slidable against the spindle housing 146. Shift of the main shaft 131*a* along tie thrust direction is restricted with second bearing 137, while the first bearing 133, the second bearing 137 and the main shaft 131*a* are provided so that the relative position among them does not change.

The positioning external thread 136 rotates along the positioning internal thread 143 by turning the bearing supporting member 135, thereby the bearing supporting member 135 shifts along the axis line direction relative to the spindle housing 146. Consequently, the main shaft 131*a* is allowed to shift along the axis line direction relative to the spindle housing 146 fixed to the carousel 132, without changing the relative position against the bearing supporting member 135.

A scale disk 156 is provided at the upper part of the handle supporting member 139, and the rotation angle of the handle supporting member 139 is confirmed using the scale panel 156.

A fluid feed port 140 for communicating into the tube 131*b* of the main shaft 131*a* is provided at the upper part of the spindle 131. The fluid such as air fed from the fluid feed port 140 is sent to the opening side at the lower end of the spindle 131 through the tube 131*b*. A housing 141 is provided around the main shaft 131*a* in the vicinity of the fluid feed port 140, which prevents the fluid other than the fluid fed from the fluid feed port 140 from invading into the tube 131*b*. A third bearing 142 is provided in the housing 141 so as not to disturb rotation of the main shaft 131*a*.

A spindle side coupling member 134 for coupling the wafer holding head is provided at the lower part of the spindle 131 protruding toward the downward of the carousel 132. The spindle side coupling member 134 is provided with an outer cylinder 147 coupled to the main shaft 131*a*, and a cylindrical positioning member 148 provided in the outer cylinder 147. Positioning of the wafer holding head coupled to the spindle side coupling member 134 is adjustable by changing the thickness of a spacer 151 integrated at the upper part of the positioning member 148.

The positioning member 148 as a centering adapter comprises a cylindrical projection 148*a* formed so as to protrude downward, a brim 148*b* formed so as to continue to the projection 148*a*, and a recess 148*c* as a space in the projection 148*a*. A feed tube 148*d*, formed along the vertical direction so as to communicate with the tube 131*b*, is provided in the projection 148*a* so as to penetrate to the lower end face of the projection 148*a*.

A head attaching internal thread 149 is formed on the inner circumference face of the outer cylinder 147 at a height opposed to the outer circumference face of the projection 148*a*. A ring-shaped recess 147*a* formed so as to follow the ring-shaped hillock 146*a* is also provided on the upper face at the outside of the outer cylinder 147. A labyrinth ring is formed with these members. Since a viscous frictional resistance and surface tension apply in the gap having a complex configuration formed with the ring-shaped hillock 146*a* the ring-shaped recess 147*a*, a fluid such as the slurry or foreign substances does not invade in the first bearing 133 side.

The wafer holding head attached to the spindle 131 will be described hereinafter with reference to FIG. 11.

Figure 11:
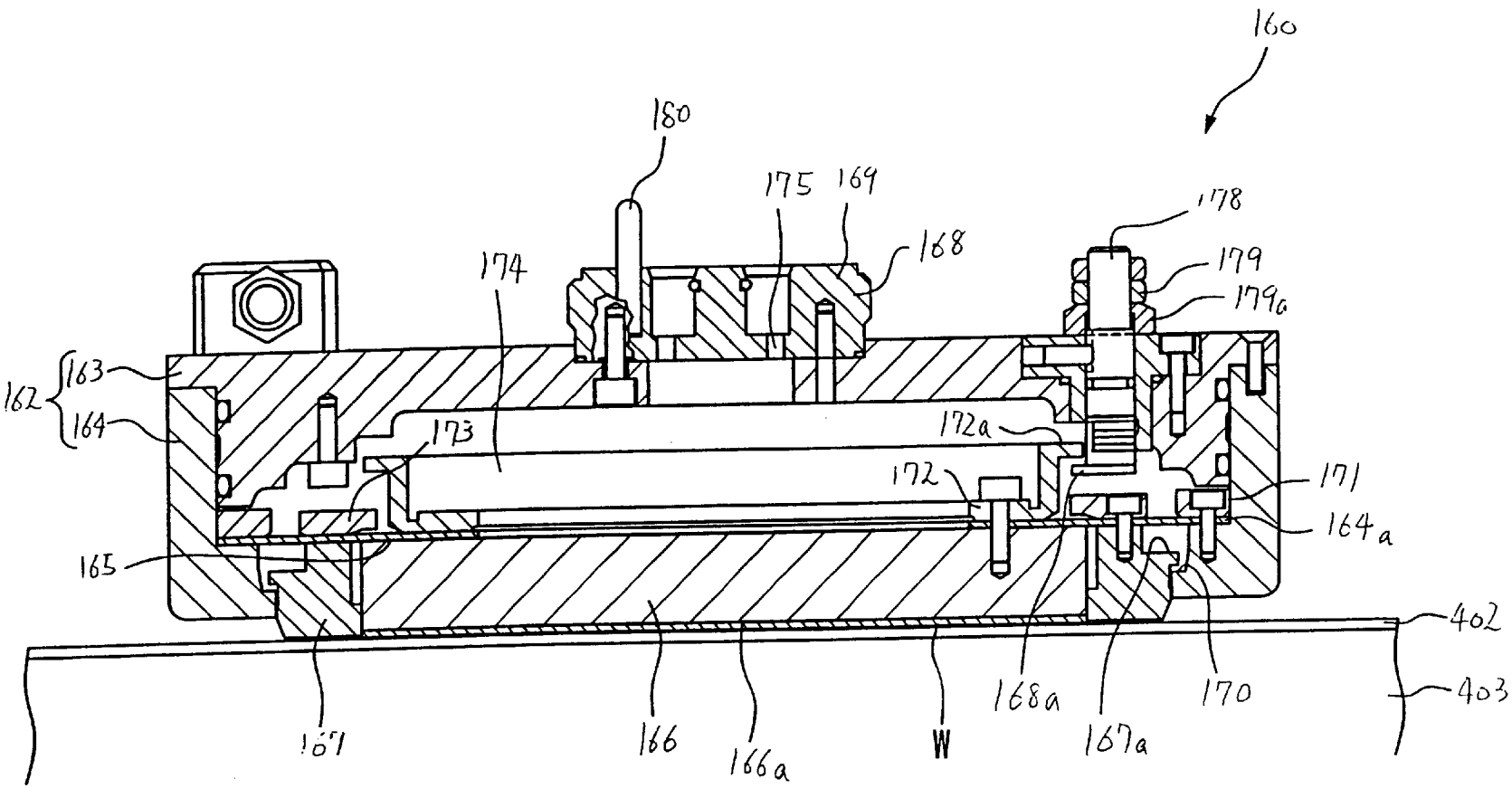
FIG. 11 shows a cross section of the wafer holding head of the wafer polishing apparatus in the fifth embodiment of the present invention.

The wafer holding head in FIG. 11 is provided with a head body 162, a diaphragm 165 expanded in the head body 162, a disk-shaped carrier 166 fixed on the lower face of the diaphragm 165, and a retainer ring 167 provided in a concentric relation to the inner wall of the circumference wall 164 and the outer circumference wall of the carrier 166. The carrier 166 and the retainer ring 167 have a floating structure movable along the axis direction by elastic deformation of the diaphragm 165.

The head body 162 is composed of a disk-shaped top plate 163 and a cylindrical circumference wall 164 fixed at below the circumference of the top plate 163, and the lower end of the head body 162 has a hollow opening. The top plate 163 is fixed in a coaxial relation to a shaft 169 as a head side coupling member for coupling with the spindle 131. A flow path 175 for communicating with a tube 131*b* in the spindle 131 is formed along the vertical direction in the shaft 169. A head attaching external thread 168 is formed on the outer circumference face of the shaft 169. A step 164*a* and a ring-shaped locking member 170, protruding toward inside along the radial direction, are formed over the entire circumference at the lower part of the circumference wall 164.

The diaphragm 165 comprising an elastic material such as a fiber reinforced rubber is formed into a ring shape or a disk shape, and is fixed with a diaphragm fixing ring 171 on the step 164*a* formed on the inner wall of the circumference wall 164.

A fluid chamber 147 is formed above the diaphragm 165, and communicates with the flow path 175 formed in the shaft 169. The pressure in the fluid chamber 147 is adjusted by feeding a fluid such as air into the fluid chamber 147 from the tube 131*b* in the spindle 131 through the flow path 175.

The carrier 166 comprising a highly rigid material such as a ceramic is approximately formed into a cylinder having a given thickness, and is fixed with a carrier fixing ring 172 provided on the upper face of the diaphragm 165. A ring-shaped step 172*a* is formed at the upper part of the carrier fixing ring 172, and engages with a step 178*a* formed at the lower end of stopper bolts 178 fixed with nuts 179, penetrating through the top plate 163 along the vertical direction, and a spacer 179*a*. Consequently, the diaphragm 165 does not suffer an excess force by allowing the step 172*a* to engage with the step 178*a*, even when the diaphragm 165 is bent downward by the weight of the carrier 166 by allowing the wafer holding head, for example, to ascend with an ascending-descending mechanism (not shown).

The retainer ring 167 is formed into a ring shape between the inner wall of the circumference wall 164 and the outer circumference face of the carrier 166, and is disposed in a concentric relation to the inner wall of the circumference wall 164 and the outer circumference face of the carrier 166 with a slight gap from the circumference wall 164 and the outer circumference face of the carrier 166. The retainer ring 167 has horizontal upper and lower end faces, and are fixed with a retainer fixing ring 173 provided at the upper face of the diaphragm 165. The step 167a is formed on the outer circumference face of the retainer ring 167. The diaphragm 167 is prevented from suffering a local force by suppressing excess downward movement of the retainer ring 167, by allowing the step 167*a* to engage with the locking member 170 when the wafer holding head ascends with the ascending-descending mechanism.

The spindle 131 and the wafer holding head 160 having the construction as described above are coupled with each other by screwing the head attaching internal thread 149 to the head attaching external thread 168 formed on the respective members.

The wafer holding head 160 is disposed at the lower part of the spindle side coupling member 134 of the spindle 131, followed by allowing the shaft 169 as a head coupling member to come close to the spindle side coupling member 134 by positioning the projection 148*a* and the flow path 175 so as to fit with each other. Positioning of the centers of the spindle 131 and the wafer holding head 160 is made easy by providing the positioning member 148 for centering the spindle side coupling member 134 as described above.

The head attaching internal thread 149 is screwed to the head attaching external thread 168 during positioning. Coupling between the wafer holding head 160 and the spindle 131 is completed when the both threads are screwed until the upper end face of the shaft 169 of the wafer holding head 160 comes in contact with the brim 148*b* of the positioning member 148 provided in the spindle side coupling member 134. The torque acting on the spindle 131 is transferred with a pin 180 engaged with the inside of the spindle side coupling member 134.

When the wafer W is polished using the wafer holding head 160 coupled to the spindle 131, the wafer W is at first affixed on the wafer affixing sheet 166*a* (an insert) provided on the lower face of the carrier 166. Then, the wafer W is allowed to contact the polishing pad 402 the surface of which is affixed on the upper face of the platen 403, while the periphery of the wafer W is locked with the retainer ring 167. Any materials that have been conventionally used for polishing the wafer may be used for the polishing pad Su, examples of them including a velour type pad prepared by impregnating a nonwoven fabric comprising polyester with a soft resin such as polyurethane, a suede type pad prepared by forming a resin foam layer comprising polyurethane foam on a substrate such as a polyester nonwoven fabric, or a resin foam sheet comprising independently foamed polyurethane.

Then, a fluid such as air is fed to a fluid feed port 140 from a fluid feed mechanism (not shown). The fed fluid flows into the fluid chamber 174 from the flow path 175 after passing through the tube 131*b*. The flow-in fluid adjusts the pressure in the fluid chamber 174 to adjust the pressing pressure of the carrier 166 and the retainer ring 167 onto die polishing pad 402. The carrier 166 and tie retainer ring 167 are supported with the diaphragm 165 and has a floating structure, by which each member is able to independently displace along the ascending and descending directions. The pressing pressure onto the polishing pad 402 is adjustable by the pressure in the fluid chamber 174.

The platen is allowed to rotate and the wafer holding head 160 is allowed to undergo a planetary motion, while adjusting the pressing pressure of the carrier 166 and the retainer ring 167 onto the polishing pad 402. The wafer W is polished by feeding the slurry from a slurry feed device onto the surface of the polishing pad 402 and on the polishing face of the wafer W.

Subsequently, the positions of the wafer W and the polishing pad 402 are adjusted by turning respective positioning handle while confirming that the wafer W is polished under best conditions. Polishing conditions of the wafer W can be confirmed using a polishing resistance sensor or by visual observation. Since the wafer holding head 160 is positioned along the direction of height by screwing the positioning external thread 136 into the positioning internal thread 143, fine tuning in $\mu$m unit is easy.

While the positioning handle 138 is manually operated, an automatic positioning using a various kinds of actuators such as a servo motor or a stepping motor is also possible.

The positioning external thread 136 at outside of the bearing supporting member 135, the positioning internal thread 143 screwed to the positioning external thread 136 and formed in the spindle housing 146, and the handle supporting member 139 fixed to the bearing supporting member 135 for turning the bearing supporting member 135 and having the positioning handle 138, are provided in respective spindles 131, which support a plurality of the wafer holding heads 160, as positioning mechanisms along the direction of height of the wafer holding heads 160. Consequently, the main shaft 131*a* can be shifted along the axis line direction by turning the bearing supporting member 135 together with the handle supporting member 139. Therefore, fine-tuning of the wafer holding heads 160 is made easy while fine-tuning the positions of the wafer W and the polishing pad 402. In addition, all the wafers W are securely polished by independently positioning respective wafer holding heads 160, even when a plurality of the wafer holding heads 160 are provided.

The polishing work can securely cope with changes of processing conditions during polishing by making fine-tuning of positions along the axis line direction possible during polishing of the wafer W. The change of the processing conditions as cited herein refers to the cases where, for example, the pressing force to each wafer W differs due to a slight change of the pressure in the fluid chamber 174 for each wafer holding head 160, the lower face of the retainer ring 167 on each wafer holding head 160 is differently deteriorated, or the thickness of the polishing pad 402 is gradually reduced.

Figure 19:
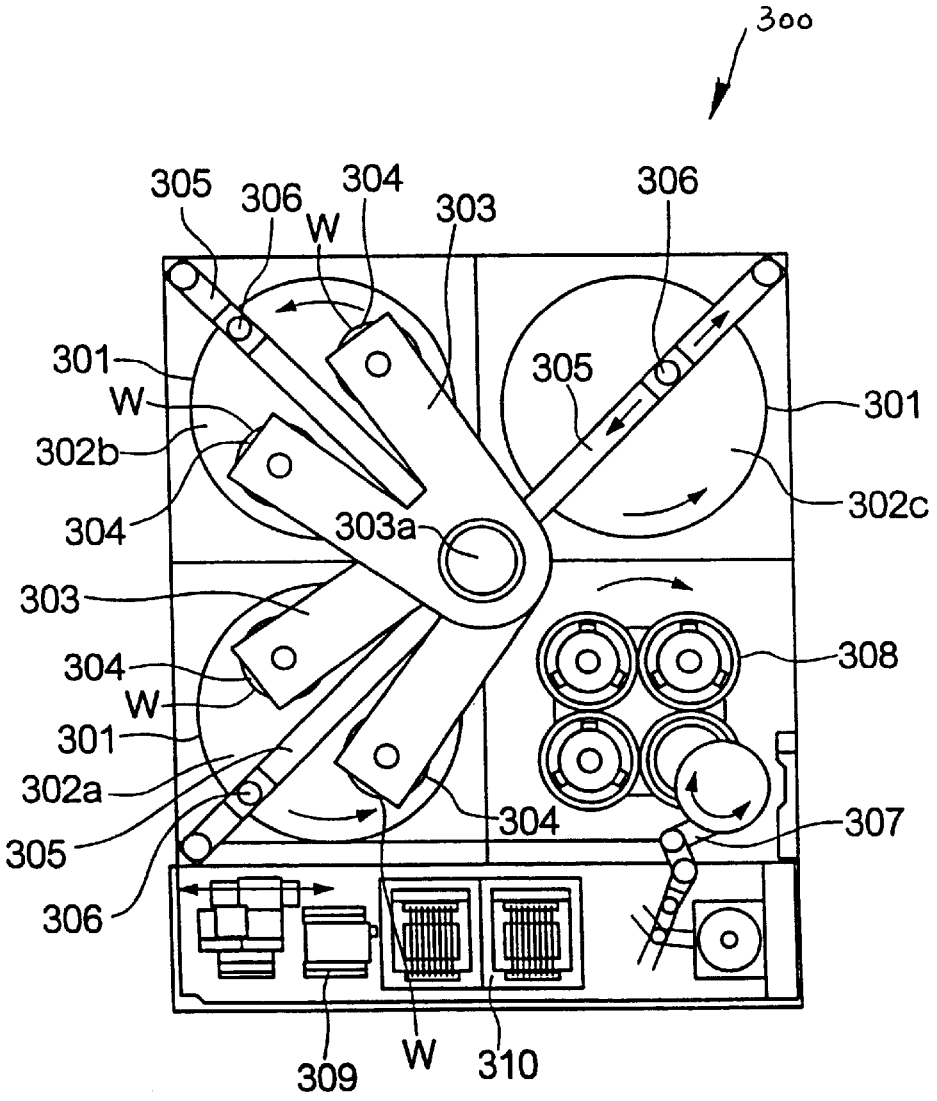
FIG.19 (PRIOR ART)
FIG. 19 illustrates the conventional wafer polishing apparatus.

The wafer polishing apparatus 300 shown in FIG. 19 is provided with rotatable three platens 301, polishing pads 302*a* and 302*b* for primary polishing and a polishing pad 302*c* for secondary polishing, two-branched arms 303 supported with a pivot 303*a* so as to be able to freely pivot, a wafer holding head 304 provided at each tip of the arm 303, and a dresser 306 that can linearly travel along a guide 305 provided along the radial direction of each polishing pad 302. Although the wafer supported by the wafer holding head 304 is polished with each polishing pad 302, fine-tuning of the wafer holding head 304 along the axis line direction is difficult.

While the wafer holding head 304 supported with the arm 303 is allowed to pivot over the polishing pads 302*a* to 302*c*, it is difficult to obtain an optimum polishing condition for each polishing pad since each polishing pad is made of a different material and has a different thickness. Although it is possible to previously set a lower limit position of the arm 303 for each polishing pad, the method involves a problem that the thickness of each polishing pad changes by polishing and dressing, or the overall construction of the apparatus turns out to be complicated.

However, the optimum height of each wafer holding head 160 can be individually adjusted, easily and cheaply, using, for example, a stepping motor.

Figure 12:
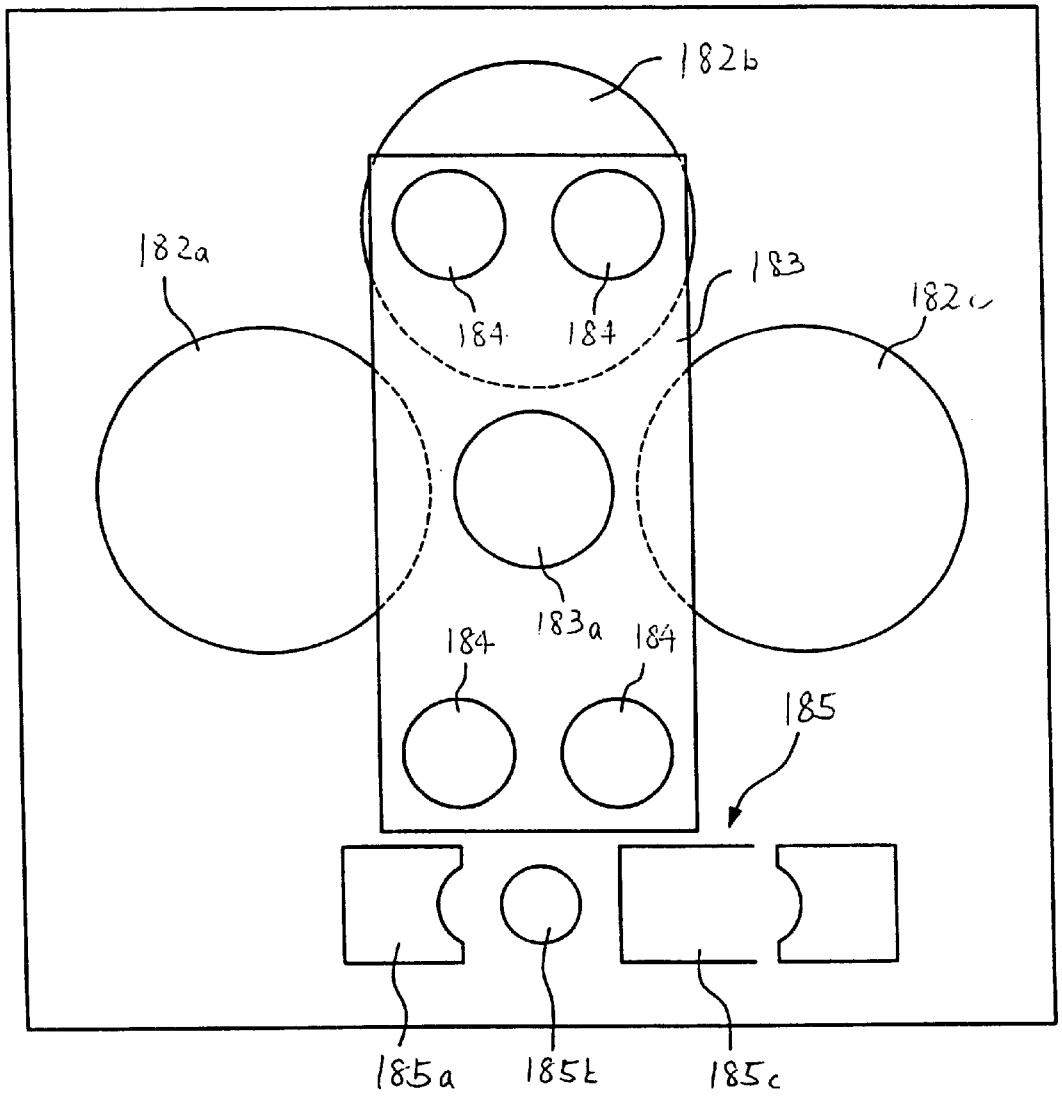
FIG. 12 shows the overall wafer polishing apparatus in one example of the fifth embodiment of the present invention.

It is difficult to position the optimum elevation of the wafer holding head 184 against each polishing head in the apparatus in which the lower limit of the arm 183 position is adjustable, wherein a plurality of wafer holding heads 184 are attached at both ends of the linear arm 183, and the wafer held on each wafer holding head 184 is polished with a different polishing pad as shown in FIG. 12. The apparatus shown in FIG. 12 is provided with arms 183*a* that are able to pivot around a pivot 183*a*, two wafer holding heads 184 provided at the tip of respective arm 183, polishing pads 182*a*, 182*b* and 182*c* disposed at an angle of 90 degree with each other along the horizontal direction, and a load-unload station 185 in opposed relation to the polishing pad 182*b*. When two wafer holding heads 184 at one end of the arm 183 are polishing using the polishing pad 182, the two wafer holding heads 184 at the other end receive and deliver at the load-unload station 185 provided with a supply cassette 185*a*, a robot 185*b* and a slider 185*c*. When the arm 183 rotates at an angle of 90 degree along the horizontal direction, on the other hand, the wafer holding head 184 at one end polish the wafer with the polishing pad 182*a* and the wafer holding head 184 at the other end polish the wafer with the polishing pad 182*c*.

A plurality of the wafer holding head 184 can also positioned at an optimum elevation by providing a height positioning mechanism according to the present invention, even in the wafer polishing apparatus constructed as described above.

Sixth Embodiment

Figure 13:
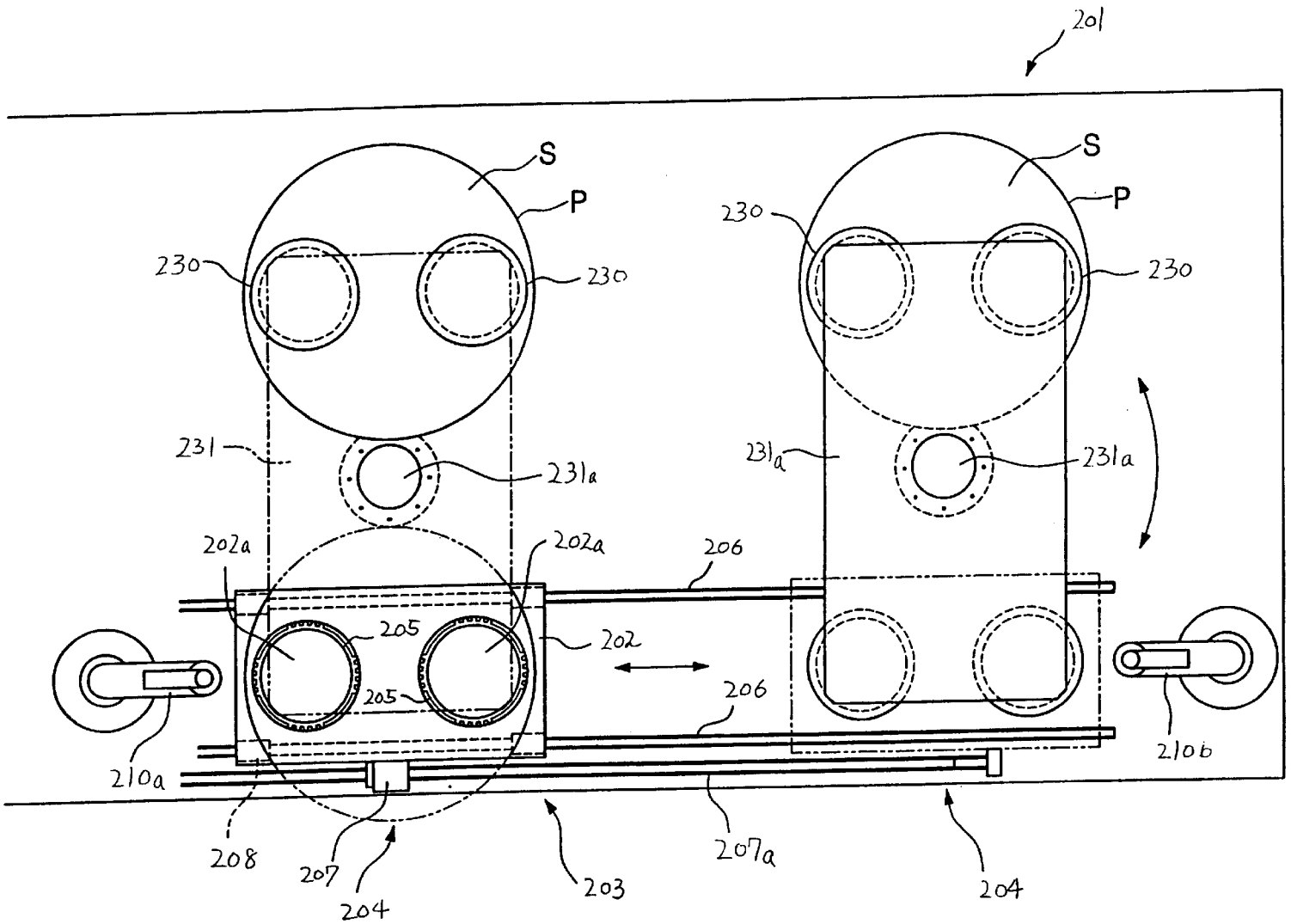
FIG. 13 shows a plane view of the wafer transfer apparatus and the wafer polishing apparatus in the sixth embodiment of the present invention.
Figure 14:
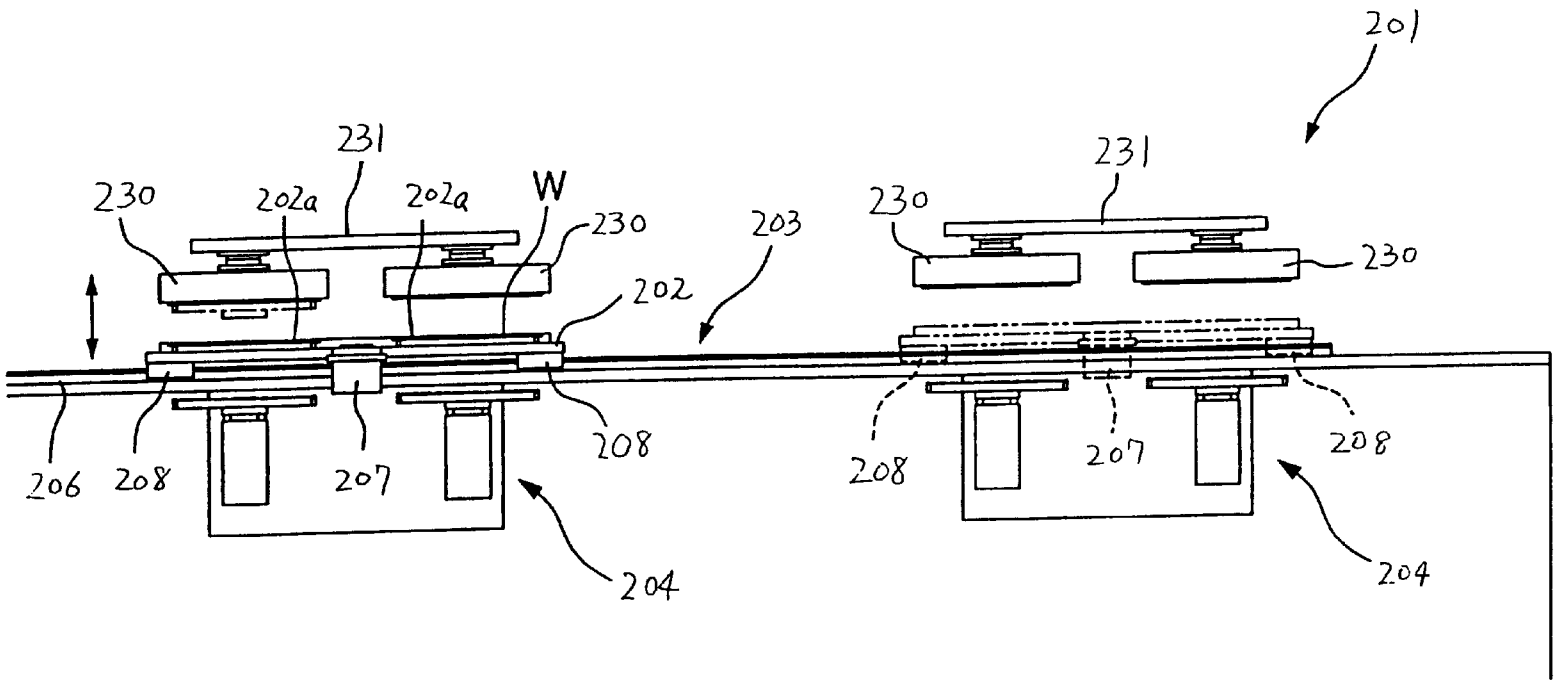
FIG. 14 shows a side view of the wafer transfer apparatus and wafer polishing apparatus shown in FIG. 13.
Figure 15:
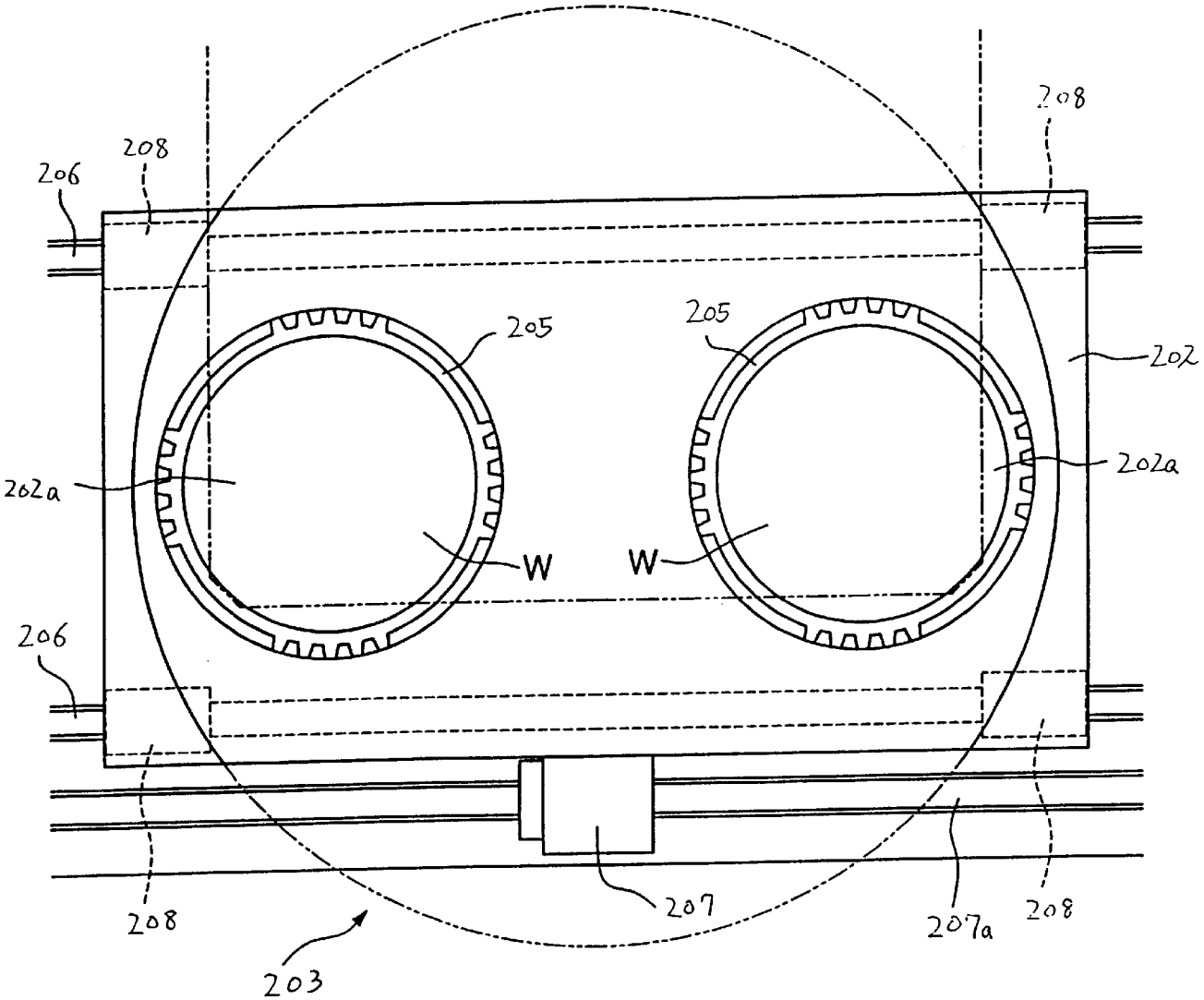
FIG. 15 shows an enlarged drawing in the vicinity of the tray of the wafer transfer apparatus and wafer polishing apparatus shown in FIG. 13.
Figure 16:
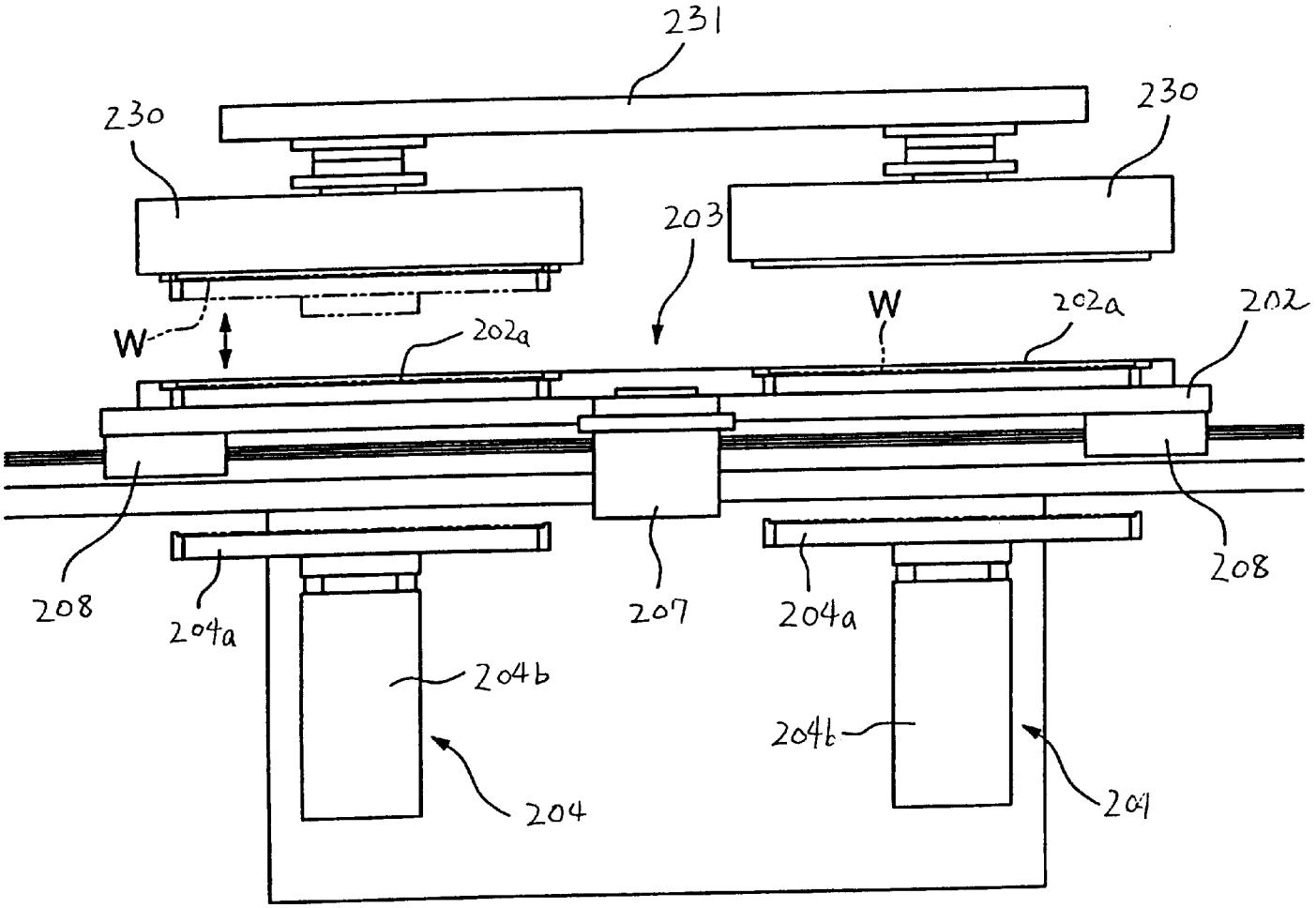
FIG. 16 shows an enlarged drawing in the vicinity of the wafer attaching-detaching mechanism of the wafer transfer apparatus and wafer polishing apparatus shown in FIG. 13.

The wafer transfer apparatus and the wafer polishing apparatus, and the method for manufacturing the wafer in the sixth embodiment according to the present invention will be described hereinafter with reference to the drawings. FIG. 13 shows a plane view viewed from upward of the wafer polishing apparatus according to the present invention, and FIG. 14 shows a side view of the apparatus in FIG. 14. FIGS. 15 and 16 show enlarged drawings of the apparatus shown in FIGS. 13 and 14, respectively.

In these drawings, the overall apparatus is provided with a tray 202 capable of mounting a plurality of wafers W, a tray travelling mechanism 203 for supporting the tray 202 so as to be able to travel, and a wafer attaching-detaching mechanism 204 provided under the tray travelling mechanism 203.

The tray 202 formed into a rectangular shape in the plane view is provided with two holes 202*a* having approximately the same diameter as the wafer W. An engage member 205 formed into a ring-shaped cogwheel is provided at each hole 202*a*, and the wafer W is supported with the tray 202 by mounting its periphery on the engage member 205.

The tray travelling mechanism 203 is provided with a guide rail 206 for supporting the tray 202 so as to freely travel along the horizontal direction, and a driving mechanism 207 for allowing the tray 202 to travel along the guide rail 206. A linear bush holder 208 fitted to the guide rail 206 is coupled to both sides of the tray 202, which travels along the longitudinal direction of the guide rail 206 by allowing the linear bush holder 208 to slide along the guide rail 206.

A driving mechanism 207 coupled to a drive rail 207*a* placed in parallel to the guide rail 206 is provided at one end of the tray 202. For example, a linear motor is used for the driving mechanism 207. The tray 202 travels along the horizontal direction toward the longitudinal directions of the guide rail 206 and the drive rail 207*a*. One tray 202 that travels along the right and left directions is provided as shown in FIG. 13.

An upstream side robot arm 210*a* and a downstream side robot arm 210*b* are provided at the upstream side and downstream side, respectively, of the travel directions of the tray 202. The upstream side robot arm 210*a* receives the wafer W from the wafer accommodation member accommodating the wafer W to be polished, holds one face of the wafer W by a wafer adsorption mechanism provided at its tip, and mounts the wafer W on the engage member 205 provided in the hole 202*a* on the tray 202. The upstream side robot arm 210*a*, which is provided to be able to pivot between the wafer accommodation member and the tray 202, pivots to above the closer hole 202*a* between the wafer accommodation member and the tray 202 while adsorbing the wafer W to be polished on its tip, and mount the wafer W by desorbing.

Likewise, the downstream side robot arm 210*b* is also provided so as to be able to pivot between the tray 202 that has allowed to travel to the downstream side and, for example the accommodation member of the polished wafer, and accommodates the polished wafer, held by the wafer adsorption mechanism at the tip of the arm, in the polished wafer accommodation member.

The tray 202 is provided to be freely rotatable along the horizontal direction, and rotates to allow a plurality of holes 202*a* to approach respective robot arms 210*a*, 210*b* and 210*c*, when the tray travels to respective robot arms 210*a* and 210*b* to receive and deliver the wafer W.

Polishing pads S, affixed on the surface of the platen P so as to be parallel to the travel direction of the tray 202, are provided at two positions separated from the guide rail 206. The upstream side (left side in FIG. 13) polishing pad S of the two pads is used for primary polishing, while the downstream side (right side in FIG. 13) polishing pad S is used for secondary polishing, each having a different material. Respective platens P are supported to be freely rotatable, and the polishing pad S is allowed to rotate by rotation of the platen P.

Any materials that have been conventionally used for polishing the wafer W may be used for the polishing pad S, examples of them including a velour type pad prepared by impregnating a nonwoven fabric comprising polyester with a soft resin such as polyurethane, a suede type pad prepared by forming a resin foam layer comprising polyurethane foam on a substrate such as a polyester nonwoven fabric, or a resin foam sheet comprising independently foamed polyurethane. The material of each polishing pad can be replaced depending on the purpose of polishing the wafer W.

Two wafer holding heads 230 are disposed above the upstream side and downstream side polishing pads S, respectively. The wafer holding heads 230 are supported to be freely rotatable at the tips of the head driving mechanisms 231 formed to have a rectangular plane view, and the trays are disposed with the same distance as the distance between the holes 202*a* of the tray 202. The two head driving mechanisms 231 are supported with a shaft 231*a* providing a rotation power source so as to be able to freely pivot. The wafer holding heads 230 travels between the upper part of the polishing pad S and the upper part of the traveling path of the tray 202, by allowing the head driving mechanisms 231 to pivot.

A plurality of the wafer attaching-detaching mechanism 204 are provided along the travel direction of the tray 202 below the guide rail 206 of the tray travelling mechanism 203. Two wafer attaching-detaching mechanisms 204 are provided so as to have the same distance as the distance of the two wafer holding heads 230 provided at the head driving mechanism 231. In total four wafer attaching-detaching mechanisms are provided so as to correspond to respective two head driving mechanism 231.

The tray 202 is provided so as to travel above the wafer attaching-detaching mechanisms 204. The wafer attaching-detaching mechanisms 204 is provided with an arm 204*a* for supporting the lower face of the wafer W, and an ascending-descending mechanism 204*b* for ascending and descending by allowing the arm 204*a* to penetrate the hole 202*a*. An air cylinder is use, for example for the ascending-descending mechanism 204*b*. The lower face of the wafer W transferred above the wafer attaching-detaching mechanisms 204 is supported with the arm 204*a*, and is allowed to ascend and descend between the tray 202 and the lower face of the wafer holding head 230.

Figure 17:
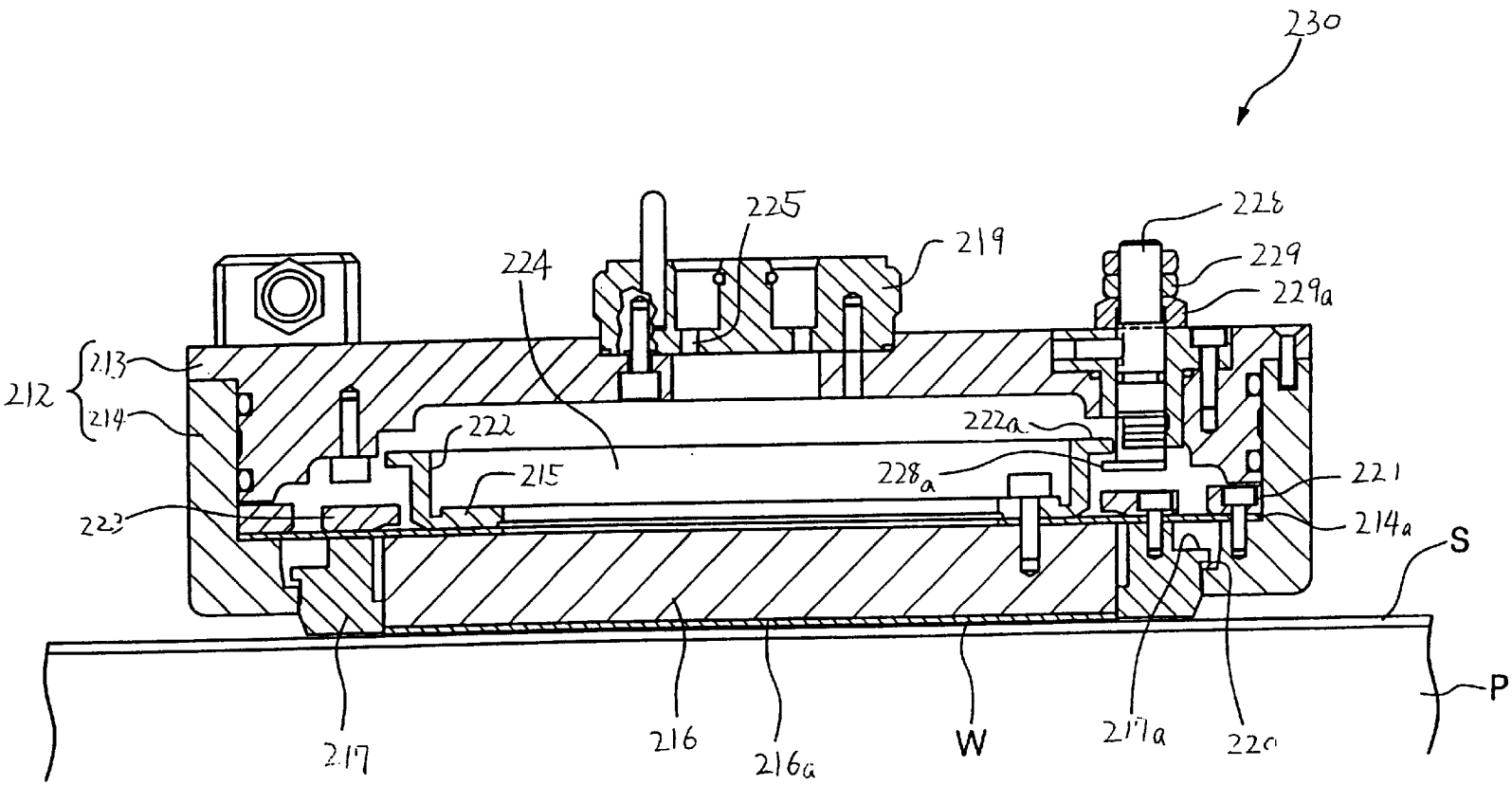
FIG. 17 shows an illustrative cross section of the wafer holding head of the wafer polishing apparatus in the sixth embodiment of the present invention.
Figure 18:
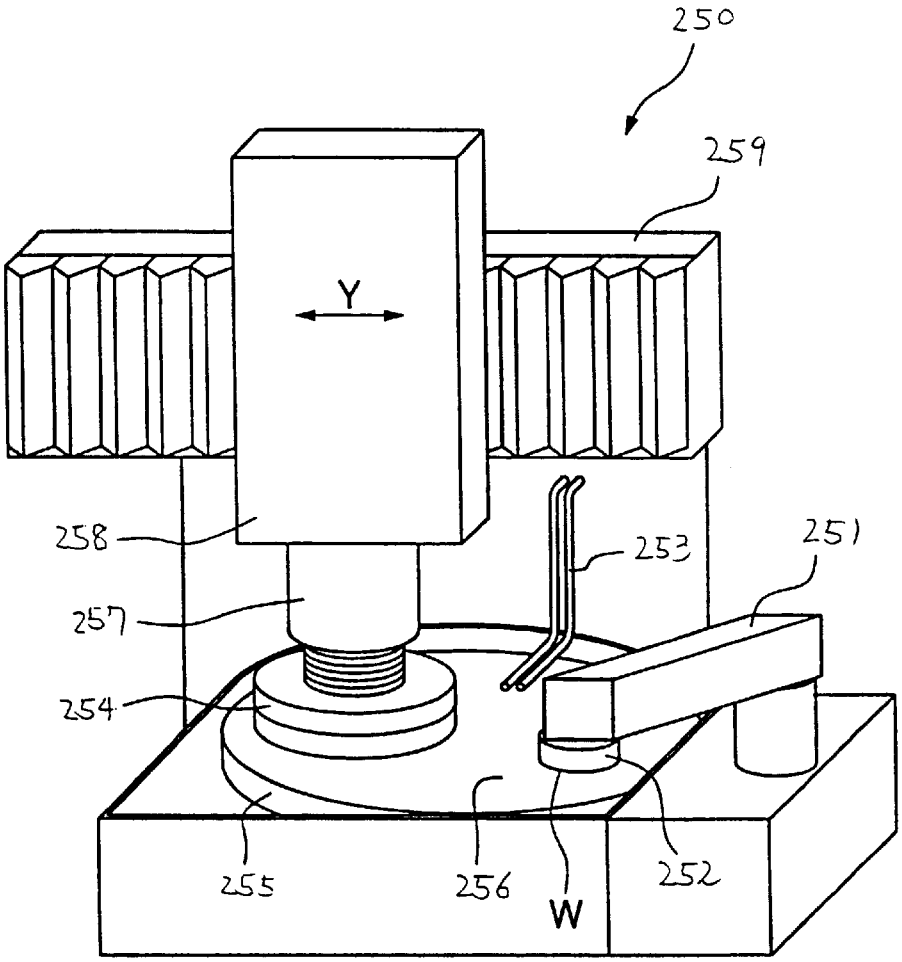
FIG. 18 illustrates the conventional wafer polishing apparatus.

The wafer holding head 230 is provided with a head body 212 comprising a top plate 213 and a cylindrical circumference wall 214, a diaphragm 215 expanded in the head body 212, a disk-shaped carrier 216 fixed to the lower face of the diaphragm 215, a ring-shaped retainer ring 217 provided in concentric relation to the inner wall of a circumference wall 214 and die outer circumference face of the carrier 216 as shown in FIG. 17.

The head body 212 is composed of the disk-shaped top plate 213 and the cylindrical circumference wall 214 fixed at the lower part of the outer circumference of the top plate 213, and the head body 212 has a open hollow lower end. The top plate 213 is fixed in coaxial relation to a shaft 219, and a flow path 225 communicating with the pressure adjustment mechanism (not shown) is formed in the shaft 219 along the vertical direction. A step 214*a* and a ring-shaped locking member 220 protruding inside along the radial direction arc formed over the entire circumference at the lower end of the circumference wall 214.

The diaphragm 215 comprising an elastic material such as a fiber reinforced rubber is formed into a ring shape or a disk shape, and is fixed on the step 214*a* with a diaphragm fixing ring 221 formed on the inner wall of the circumference wall 214.

A fluid chamber 224 is formed above the diaphragm 215, and communicates with a flow path 225 formed in the shaft 219. The pressure in a fluid chamber 224 is controlled by feeding a fluid such as air in the fluid chamber 224 through the flow path 225 from a pressure adjustment mechanism (not shown).

The carrier 216 comprising a highly rigid material such as a ceramic is formed approximately into a cylinder having a given thickness, and is fixed with a carrier fixing ring 222 provided on the upper face of the diaphragm 215. A ring-shaped step 222*a* is formed at the upper part of the carrier fixing ring 222, and engages with a step 228*a* formed at the lower end of stopper bolts 228 fixed with nuts 229, penetrating through the top plate 213 along the vertical direction, and a spacer 229*a*. Consequently, the diaphragm 215 does not suffer an excess force by allowing the step 222*a* to engage with the step 228*a*, even when the diaphragm 215 is bent downward by the weight of the carrier 216 by allowing the wafer holding head, for example, to ascend with an ascending-descending mechanism.

The retainer ring 217 is formed into a ring shape between the inner wall of the circumference wall 214 and the outer circumference face of the carrier 216, and is disposed in a concentric relation to the inner wall of the circumference wall 214 and the outer circumference face of the carrier 216 with a slight gap from the circumference wall 214 and the outer circumference face of the carrier 216. The retainer ring 217 has horizontal upper and lower end faces, and are fixed with a retainer fixing ring 223 provided at the upper face of the diaphragm 215. The step 217*a* is formed on die outer circumference face of the retainer ring 217. The diaphragm 215 is prevented from suffering a local force by suppressing excess downward movement of the retainer ring 217, by allowing the step 217*a* to engage with the locking member 220 when the wafer holding head ascends with the ascending-descending mechanism.

Various kinds of wafer holding head 230, for example an apparatus in which the head polishing mechanism 231 and the wafer holding head 230 is supported with a ball bearing so as to be freely inclined, may be used.

The operations of the wafer transfer apparatus and the wafer polishing apparatus constructed as described above will be described hereinafter.

The wafer W to be polished accommodated in the wafer accommodation member is taken out with the upper stream side robot arm 210*a*, for mounting the wafer W to be polished on the tray 202. The upper face of the wafer W to be polished is held with a wafer adsorption mechanism provided at the tip of the upper stream side robot arm 210*a*.

The upper stream side robot arm 210*a* holding the wafer W is allowed to pivot above the travelling path of the tray 202. The tray travels at the upper stream side robot arm 210*a*. Then, the wafer W held by the upper stream side robot arm 210*a* is disposed above the closer hole 202*a* of the two holes 202*a* formed on the tray 202. The wafer W is mounted on the engage member 205 provided in the hole 202*a*, by releasing the wafer W from the wafer adsorption mechanism.

After supporting one hole 202*a* of the two holes 202*a* formed in the tray 202, the tray 202 is allowed to rotate. The other hole 202*a* is disposed to come close to the upstream side robot arm 210*a* by allowing the tray 202 to rotate. Subsequently, the wafer W to be polished is taken out of the wafer accommodation member with the upstream side robot arm 210*a* as described above, and the wafer W is mounted on the other hole 202*a*, thereby two wafers W to be polished are mounted on the tray 202.

The tray 202 on which the wafers W to be polished are mounted is allowed to horizontally travel toward the upstream side along the guide rail 206 by allowing the driving mechanism 207 to actuate, while the two wafer holding heads 230 are disposed at the guide rail 206 side that lies on the travel path of the tray 202 by allowing the head driving mechanism 231 to pivot. The wafer holding head 230 moved on the travel path of the tray 202 is positioned in opposed relation to the wafer attaching-detaching mechanism 204.

The tray 202 mounting the wafer W to be polished allows the wafer W to travel so as to be disposed between the wafer holding heads 230 and the wafer attaching-detaching mechanism 204, and stops there.

Respective arms 204*a* of the wafer attaching-detaching mechanism 204 ascend after the operation described above, and respective wafers W mounted on the locking member 205 of the hole 202*a* are supported from below with the arm 204*a*. The wafer W comes close to the wafer holding head 230 by further ascending the arm 204*a* to hold the wafer on the lower face of the wafer holding head. Thus, the wafer W is affixed on the wafer affixing sheet 216*a* (an insert) provided on the lower face of the carrier 216, and the periphery of the wafer W is locked with the retainer ring 217.

The head driving mechanism 231 pivots for polishing the wafer W attached to the wafer holding head 230, the wafer holding head 230 holding the wafer W to be polished is disposed above the polishing pad S to allow the surface of the wafer to contact the polishing pad S affixed on the surface of the platen P.

The pressure in the fluid chamber 224 is adjusted by allowing a fluid such as air to flow into the fluid chamber 224 from the flow path 225 to adjust the pressing pressure of the carrier 216 and the retainer ring 217 onto the polishing pad S. The carrier 216 and the retainer ring 217 has planar structures supported with the diaphragm 215 by which the carrier 216 and the retainer ring 217 are independently able to displace along the ascending and descending directions. The pressing pressure onto the polishing pad S is adjustable by the pressure in the fluid chamber 224.

The primary polishing of the wafer W is carried out by allowing the wafer W held on the wafer holding head 230 to rotate on the polishing pad S. When the primary polishing of the wafer W has completed, the head driving 231 mechanism is again allowed to pivot, thereby the tray 202 that has been moved above the wafer attaching-detaching mechanism 204 is allowed to oppose the wafer W. The arm 204*a* of the wafer attaching-detaching mechanism 204 ascends while the tray 202 penetrates through the hole 202*a* from below. The lower face of the wafer W is supported with the arm 204*a*, and the wafer W is released from the wafer holding head 230 to mount it on the arm 204*a*. The wafer W after the primary polishing is loaded on the tray 202 by descending the arm 204*a* supporting the wafer W.

The wafer W after completing the primary polishing is attached to the downstream side wafer holding head 230 for the secondary polishing. The tray 202 mounting the wafer W travels toward the downstream, and disposed above the downstream side wafer attaching-detaching mechanism 204. Then, as in the primary polishing, the head driving mechanism 231 at the downstream side is allowed to pivot to dispose the downstream side wafer attaching-detaching mechanism 204 above the tray 202. The wafer W after completing the primary polishing is attached to the wafer holding head 230 for the secondary polishing. The wafer is polished by allowing the wafer holding head 230 on the upper face of the secondary polishing pad S by pivoting the head driving mechanism 231.

It is possible to deliver the wafer W to be polished, which is accommodated in the wafer accommodation member, using the upstream side robot arm 210*a* on way of the secondary polishing of the wafer W, by allowing the tray 202 to move toward the upstream side. The wafer W to be polished is held with the wafer holding head 230 after traveling toward the downstream side for the primary polishing of the wafer. In other words, the primary polishing and the secondary polishing are independently and simultaneously carried out by providing a time lag between the primary polishing and the secondary polishing.

The wafer W after completing the secondary polishing is mounted on the tray 202 with the downstream side wafer attaching-detaching mechanism, as in the primary polishing. The tray 202 has travelled toward the downstream side after delivering the wafer to the wafer holding head 230 for the primary polishing. The tray 202 mounting the wafer W after completing the secondary polishing is transferred to the downstream side robot arm 210*b* with the driving mechanism 207. One face of the wafer W is held with the wafer adsorption mechanism of the downstream side robot arm 210*b*, and the wafer is accommodated in the polished wafer accommodation member by allowing the robot arm 210*b* to pivot.

The tray 202 after delivering the polished wafer W to the downstream side robot arm 210*b* travels toward the upstream side again, in order to receive the wafer W after the primary polishing and to transfer it to the secondary polishing step. Accordingly, the tray 202 is constructed to be able to freely travel for receiving the wafer W from and for delivering wafer W to the upstream side and downstream side robot arms 210*a* and 210*b*, and the primary and secondary wafer holding heads 230.

The tray 202 horizontally transfers the wafer W. The wafer W is attached to and detached from the wafer holding head 230 by allowing the tray 202 to travel below the wafer holding head 230 using the wafer attaching-detaching mechanism 204 provided there. Consequently, individual mechanism becomes simple and compatible for high speed operation, besides reliability the apparatus is improved to make maintenance easy.

In the construction in which the transfer mechanism and the attaching-detaching mechanism are separated with each other, the tray 202 may rapidly and accurately perform horizontal linear travelling and stop at the destination, while the wafer attaching-detaching mechanism may rapidly and accurately attach the wafer W to and detach from the wafer holding head 230. In other words, the mechanisms rapidly and accurately operate without making the control system for controlling the operation of respective mechanisms complicated. Therefore, each function is made to be high speed with reliable operation, besides making maintenance easy.

The wafer attaching-detaching mechanism 204 is placed with a distance apart from the polishing pad S as a polishing mechanism of the wafer W, and the wafer holding head 230 travels between above the polishing pad S and the above the wafer attachingdetaching mechanism 204 by pivoting the head driving mechanism 231. The wafer holding head 230 travels above the wafer attaching-detaching mechanism 204, on the other hand, when the wafer is attached to and detached from the wafer holding head 230, while the wafer holding head 230 travels above the polishing pad S when the wafer W is polished. Consequently, the attaching and detaching operations of the wafer W is securely carried out with no interaction with each other, thereby making the respective mechanisms simple.

The tray 202 is supported to be able to freely travel between below the wafer holding head 230 and above the wafer attaching-detaching mechanism 204, while the wafer attaching-detaching mechanism 204 provides the arm 204 that is able to ascend and descend. Therefore, the wafer W on the tray 202 transferred to below the wafer holding head 230 is securely attached to and detached from the wafer holding head 230 using the arm 204*a*.

A plurality of the polishing pads S as polishing mechanisms of the wafer W, and a plurality of the wafer holding heads 230 are provided along the travel direction of the tray 202. Consequently, different kinds of girding such as the primary and secondary polishing can be simultaneously performed using different polishing pads S and abrasive depending on respective polishing mechanisms.

The tray 202 is allowed to travel above the plural wafer attaching-detaching mechanisms 204 corresponding to the polishing mechanisms as described above, while respective wafer holding heads 230 are provided so that they can independently travel with a time lag on the traveling path of the tray 202 by allowing the head driving mechanism 231 to pivot. Consequently, the attaching step of the wafer W to and the detaching step of the wafer W from the wafer holding heads 230, and polishing step of the wafer W become independent with each other, reducing the pause interval among the steps. Accordingly, throughput of the process is improved to allow the wafer W to be efficiently polished and transferred.

The tray 202 is able to travel while mounting a plurality of wafers W, which are efficiently transferred. Since the tray 202 is able to mount the wafer W while it is rotating even when a plurality of the wafers W are mounted by making the tray 202 to be rotatable, mounting of the wafers are made easy. In other words, it is possible to receive the wafer W from and deliver the wafer W to the tray 202 using the robot arms 210*a* and 210*b*, after allowing the tray 202 to rotate so that the hole 202*a* of the tray 202 comes close to respective robot arms 210*a* and 210*b*. Consequently, tie wafer W can be placed on each hole 202*a* without providing a flexible function in the robot arms 210*a* and 210*b*.

Since the tray 202 is freely rotatable, the construction of the robot arms 210*a* and 210*b* turn out to be simple, besides operating the apparatus at high speed and improving its reliability.

The present invention is not necessarily limited to the embodiments as hitherto set forth, but any modifications including combinations of die forgoing embodiment (for example, a combination of the first embodiment, and any one of die second to fourth embodiments, or a combination of the first to fourth embodiments, and the fifth or sixth embodiment) may be provided.

What is claimed is:

1. A wafer polishing apparatus comprising:

a platen;

a polishing pad affixed on the platen;

a wafer holding head configured to hold a wafer to contact a surface of the polishing pad, the wafer being configured to be polished by a relative motion between the wafer holding head and the platen; and a dress ring provided to surround the wafer holding head to be relatively movable with respect to the wafer holding head, the dress ring having an abrasive grain layer which is configured to contact the surface of the polishing pad to dress the surface of the polishing pad.

2. A wafer polishing apparatus according to claim 1, wherein the dress ring having a smaller diameter then the diameter of the polishing pad is mounted on the surface of the polishing pad, and wherein the dress ring rotates by friction with the rotating polishing pad.

3. A wafer polishing apparatus comprising:

a platen;

a polishing pad affixed on the platen;

a wafer holding head configured to hold a wafer to contact a surface of the polishing pad and having a lower face facing the surface of the polishing pad, the wafer being configured to be polished by a relative motion between the wafer holding head and the platen;

a slurry pocket formed in the lower face of the wafer holding head to accommodate slurry and having an opening on a side of the surface of the polishing pad; and a slurry feed member configured to feed the slurry to the slurry pocket.

4. A wafer polishing apparatus according to claim 3, wherein the wafer holding head comprises a retainer ring, which is provided to be able to displace along the head axis direction for locking the periphery of the wafer while making contact with the polishing pad during polishing of the wafer, and wherein the slurry pocket is formed on the lower face of the retainer ring.

5. A wafer polishing apparatus according to claim 4, wherein the wafer holding head comprising:

a head body comprising a top plate, and a cylindrical circumference wall provided below the outer circumference of the top plate;

a diaphragm substantially vertically expanded to the head axis line in the head body;

a pressure adjustment means for adjusting the pressure of a fluid filled in a fluid chamber formed between the diaphragm and the head body; and a carrier, fixed to the diaphragm and provided so as to be able to displace along the head axis line direction together with the diaphragm, for holding one face of a wafer to be polished, wherein the retainer ring being fixed to the diaphragm while being disposed in concentric relation between the inner wall of the circumference wall and the outer circumference of the carrier, the slurry pocket communicating with the slurry feed member through:

a retainer ring tube formed in the retainer ring, and communicating with the slurry pocket;

a head body tube formed in the head body, and communicating with the slurry feed member; and a flexible tube comprising a flexible member connecting between the head body tube and the retainer ring tube.

6. A wafer polishing apparatus according to claim 3, the wafer holding head comprising:

a head body comprises a top plate, and a cylindrical circumference wall provided below the outer circumference of the top plate;

a diaphragm substantially vertically expanded to the head axis line in the head body;

a pressure adjustment means for adjusting the pressure of a liquid filled in a fluid chamber formed between the diaphragm and the head body; and a carrier fixed to the diaphragm, which is provided so as to be able to displace along the head axis direction, for holding one face of a wafer to be polished, wherein the retainer ring, fixed to the diagram, is disposed in a concentric relation between the inner wall of the circumference wall and the outer circumference of the carrier, the slurry pocket communicating with the slurry feed device through:

a retainer ring tube formed in the retainer ring and communicates with the slurry pocket;

a head body tube formed in the head body and communicating with the slurry fed member; and a flexible tube comprising an elastic member connecting the head body tube and the retainer ring tube.

7. A wafer polishing apparatus according to claim 3, wherein an outer ring, which is disposed in concentric relation to the head body, which is provided so as to be able to displace along the axis line, and which comes in contact with the polishing pad during polishing, is provided at the outside of the wafer holding head; and wherein the slurry pocket is formed between the wafer holding head and the outer ring.

8. A wafer polishing apparatus according to claim 7, the wafer holding head comprising:

a head body comprising a top plate and a cylindrical circumference wall provided below the top plate;

a diaphragm substantially vertically expanded to the head axis line in the head body;

a pressure adjustment means for adjusting the pressure of a fluid filled in a fluid chamber formed between the diaphragm and the head body;

a carrier, fixed to the diaphragm and provided so as to be able to displace along the head axis direction, for holding one face of a wafer to be polished; and a retainer ring, which is disposed in concentric relation between the inner wall and the outer circumference of the carrier, which is fixed to the diaphragm, and which is provided so as to be able to displace along the head axis direction together with the diaphragm, for making contact with die polishing pad during polishing, wherein the retainer ring is disposed in concentric relation on the circumference wall, and wherein the slurry pocket communicates with the slurry feed member through the head body tube formed so as to penetrate into the lower face of the circumference wall.

9. A wafer polishing apparatus according to claim 3, the wafer holding head comprising:

a retainer ring, which is provided so as to be able to displace along the axis line, for locking the periphery of the wafer while making contact with the polishing pad during polishing; and an outer ring, which is disposed in concentric relation to the head body, and which is provided so as to be able to displace along the axis direction, for making contact with the polishing pad during polishing at the outside of the wafer holding head, wherein the slurry pocket is formed on the lower face of the retainer ring, and between the wafer holding head and the outer ring.

10. An wafer polishing apparatus according to claim 3, the wafer holding head comprising:

a head body comprising a top plate and a cylindrical circumference wall provided below the outer circumference of the top plate;

a diaphragm substantially vertically expanded to the head axis line in the head body;

a pressure adjustment means for adjusting the pressure of a fluid filled in a fluid chamber formed between the diaphragm and the head body;

a carrier, which is fixed to the diaphragm, and which is provided so as to be able to displace together with the diaphragm along the head axis direction, for folding one face of a wafer to be polished; and a retainer ring, which is disposed in concentric relation between the inner wall and the outer circumference of the carrier, which is fixed to the diaphragm, and which is provided so as to be able to displace along the head axis direction together with the diaphragm, for making contact with the polishing pad during polishing, wherein the retainer ring is disposed in concentric relation to the outer wall of the circumference wall, and wherein the slurry pocket communicates with the slurry feed member through the head body tube formed so as to penetrate into the lower face of the circumference wall.

11. A wafer polishing apparatus provided with a platen on the surface of which a polishing pad is affixed, and a wafer holding head, which holds a wafer to be polished, for allowing the polishing pad to contact one face of the wafer, the wafer being polished with the polishing pad by a relative motion between the wafer holding head and the platen, wherein a slurry holding ring, which is allowed its lower face to contact the polishing pad, and which is disposed so as not to contact the periphery of the wafer holding head, is rotatably provided at the outside of the wafer holding head.

12. A wafer polishing apparatus according to claim 11, wherein a slurry feed member for feeding a slurry between the outer circumference of the wafer holding head and the inner circumference of the slurry holding ring is provided.

13. A wafer polishing apparatus according to claim 12, wherein an outlet for discharging a slurry to outside is formed at a part of the wall of the slurry holding ring.

14. A wafer polishing apparatus according to claim 11, wherein an outlet for discharging a slurry to outside is formed at a part of the wall of the slurry holding ring.

* * * * *